US008070000B2

(12) United States Patent
Botwright et al.

(10) Patent No.: US 8,070,000 B2
(45) Date of Patent: Dec. 6, 2011

(54) APPARATUS AND METHOD FOR ASSEMBLING WIND TURBINES

(75) Inventors: Adrian Botwright, Sabro (DK); Henning Nørholm Just, Risskov (DK); Kristian Kaagaard Hansen, Tjele (DK)

(73) Assignee: Vestas Wind Systems A/S, Randers SV (DK)

( * ) Notice: Subject to any disclaimer, the term of this patent is extended or adjusted under 35 U.S.C. 154(b) by 25 days.

(21) Appl. No.: 12/604,817

(22) Filed: Oct. 23, 2009

(65) Prior Publication Data

US 2011/0094987 A1 Apr. 28, 2011

(51) Int. Cl.
*B66C 7/00* (2006.01)

(52) U.S. Cl. ..... 212/228; 212/227

(58) Field of Classification Search ..... 212/225–228, 212/256

See application file for complete search history.

(56) References Cited

U.S. PATENT DOCUMENTS

| | | | | |
|---|---|---|---|---|
| 2,709,526 | A | 5/1955 | Hansen | |
| 3,034,661 | A * | 5/1962 | Pollack et al. | 212/227 |
| 4,561,551 | A * | 12/1985 | Goussinsky | 212/312 |
| 2007/0266538 | A1 | 11/2007 | Bervang | |

FOREIGN PATENT DOCUMENTS

| | | |
|---|---|---|
| AU | 2008317693 | 3/2010 |
| DE | 299 08 395 | 10/1999 |
| DE | 10 2008 053 404 | 4/2010 |
| WO | 03100249 | 12/2003 |
| WO | 2008061797 | 5/2008 |
| WO | 2009/041812 | 4/2009 |

OTHER PUBLICATIONS

Sven Nytoft Rasmussen; 1st Technical Examination and Search Report issued in related Denmark Patent Application No. PA 2009 70170; Jun. 2, 2010; 6 pages; Denmark Patent and Trademark Office.

Omiros Verheul; International Search Report and Written Opinion issued in related International Application No. PCT/EP2010/066002; Mar. 7, 2011; 13 pages; European Patent Office.

* cited by examiner

*Primary Examiner* — Emmanuel M Marcelo

(74) *Attorney, Agent, or Firm* — Wood, Herron & Evans, L.L.P.

(57) ABSTRACT

An apparatus for assembling a wind turbine includes a crane boom having a main bearing cable coupled to a component for lifting the component during assembly of the wind turbine, and a control mechanism coupled to the crane boom for controlling the orientation of the wind turbine component during the lift. The control mechanism includes a guide member coupled to the crane boom, a movable member coupled to the guide member and configured to be movable relative to the crane boom, a coupling member configured to couple the movable member to the wind turbine component being lifted by the crane boom, and a drive mechanism configured to actively move the movable member relative to the crane boom independent of the movement of the main bearing cable. A method for assembling a wind turbine includes using the coupling member to change the orientation of the component.

29 Claims, 19 Drawing Sheets

APPARATUS AND METHOD FOR ASSEMBLING WIND TURBINES

TECHNICAL FIELD

The invention relates generally to improved apparatus and methods for assembling wind turbines and, more particularly, to a crane having improved features that provide enhanced control of wind turbine components during assembly thereof.

BACKGROUND

Wind turbines for converting wind energy to electrical power have been known and applied for many years, but have found a dramatically increased application as an alternative energy source during the last couple of decades. With this renewed interest in wind power, wind turbine designs have seen significant advancements that, in turn, have allowed wind turbines to significantly increase in size and weight. By way of example, modern wind turbines may have rotors approaching 100 to 150 meters in diameter. Additionally, the weight of, for example, three wind turbine blades may be as high as 40 to 50 tons. Consequently, the assembly of wind turbines has presented some challenges for manufacturers. These challenges are not only due to the increased size and weight of the wind turbine components, but also due to shifting from traditional mounting locations to more extreme, difficult-to-access areas, such as mountainous areas and offshore sites.

One conventional technique for assembling a wind turbine includes transporting the different components to the construction site; assembling the tower sections that collectively form the tower; lifting the nacelle with a crane and mounting the nacelle on top of the tower; assembling the wind turbine rotor on the ground; and lifting the wind turbine rotor with the crane and mounting the rotor to the low-speed shaft extending from the nacelle. Depending on the particular size of the wind turbine, particular location, or other factors, the assembly process may be suitably modified. For example, the rotor hub may be coupled to the nacelle prior to mounting the nacelle on the tower, and the blades individually lifted with the crane and mounted to the hub. Those of ordinary skill in the art may recognize alternative combinations for assembling the wind turbine.

No matter which of the multiple conventional techniques utilized to assemble the wind turbine, aspects of the assembly process typically include lifting relatively large, heavy components with a crane to a height that is a significant distance off the ground, such as adjacent the top of the tower. One consideration with such an assembly step is directed to adequately and safely controlling the component during the lift. For example, during assembly, it may be important to control the orientation of the component so as to be able to mount the component to the wind turbine (e.g., nacelle, rotor hub, blade, etc.). Additionally, it may be desirable to control the component to prevent or minimize damage thereto during the lift, such as might occur by contacting the tower, the crane, or other nearby objects.

In this regard, conventional approaches for controlling the component during the lift include coupling a number of tag lines (e.g., long ropes) to the component. More particularly, one end of each tag line is coupled to the component being lifted by the crane. The length of the tag lines is such so as to position another end thereof adjacent the ground or other support surface, such as, for example, a boat or platform for offshore installations. Assembly workers on the ground or support surface then grab the tag lines and manually manipulate or control the movements of the components during the lift and installation of the component. Depending on the particular size of the wind turbine, there may be several such tag lines for controlling the various components during assembly.

The increasing size of wind turbines has made the use of manually-operated tag lines to control the orientation of wind turbine components more challenging. First, even with multiple tag lines, the orientation of the component being lifted by the crane is difficult to control. One reason is that when the component is lifted so as to be adjacent the top of the tower, the tag lines may be nearly perpendicular to the horizontal plane in which rotational control of the component is desired. As the inclination angle between the horizontal plane of the component being lifted by a crane and the tag line increases, the ability to control the orientation of the component within that horizontal plane generally decreases.

Moreover, when the wind turbine component is adjacent the top of the tower, the control point for the tag line, such as the point on the ground, boat, platform, etc. on which the assembly worker stands to grab the tag line, is at its maximum distance from the component. When using tag lines to control the component being lifted by a crane, control of the load is generally inversely proportional to the distance between the control point and the load. Thus, when using tag lines, control of the wind turbine component is generally minimized when the need to control the component is generally at its maximum (e.g., when the component is near the top of the tower).

The limited ability of manually-controlled tag lines to control the wind turbine component during lift results in a need that nearly ideal weather conditions have to be present for assembly to occur. Thus, for example, as it currently stands with the conventional tag line technique, assembly will only be attempted when wind speeds do not exceed a certain threshold, such as, for example, 12 m/s. In some environments, the number of days having such conditions may be limited, and the occurrence of these ideal-condition days is often unpredictable. The inability to assemble wind turbines in a wider range of environmental conditions presents logistical issues related to the scheduling of personnel and equipment necessary for the installation.

In addition to the above, conventional tag line techniques typically require a relatively large number of personnel on the ground to facilitate control of the wind turbine component during a crane lift. Additionally, conventional tag line techniques often result in control of the component being dispersed among several different people, (e.g., crane operator, tag line personnel) all needing the ability to effectively communicate to successfully achieve assembly. Such decentralized control may result in increased assembly time and assembly costs.

Thus, while conventional tag line control techniques are generally successful for their intended purpose, there remains a need for improved apparatus and methodologies for enhancing the control of wind turbine components during assembly thereof.

SUMMARY

An improved apparatus and method is disclosed herein to address these and other drawbacks of existing apparatus and methodologies. An apparatus for assembling a wind turbine includes a crane boom having a main bearing cable configured to be coupled to a wind turbine component for lifting the component during assembly of the wind turbine, and a control mechanism operatively coupled to the crane boom for controlling the orientation of the wind turbine component during the lift. The control mechanism includes a guide member coupled to the crane boom, a movable member coupled to the guide member and configured to be movable relative to the crane boom, a coupling member configured to couple the movable member to the wind turbine component being lifted by the crane boom, and a drive mechanism configured to actively move the movable member relative to the crane boom independent of the movement of the main bearing cable.

In one embodiment, the guide member may include one or more guide rails. In an alternative embodiment, the guide member may include one or more guide cables. In one embodiment, the movable member may include a carriage movably mounted on the guide member and movable relative thereto. In other embodiments, however, the movable member may include a plate member spliced into the guide member such that movement of the movable member is achieved by movement of the guide member. In one embodiment, the coupling member may include a fixed length cable. Yet in other embodiments, the coupling member may include an adjustable length cable. For example, in one embodiment, the coupling member may include a winch and a tag line operatively coupled to the winch. The winch may be configured to reel in and pay out the tag lines to adjust the length of the coupling member. Additionally, in one embodiment, the winch may be coupled to the movable member so as to move therewith. In other embodiments, the winch may be located in spaced relation to the movable member. In such an embodiment, the movable member may include a sheave for receiving a portion of the tag line.

In one embodiment, the drive mechanism may include a rack and gear arrangement for moving the movable member along the guide member. For example, the guide member may include the rack extending along a portion thereof, and the movable member may include a driven gear (such as with a controllable motor). When the motor is activated, the gear drives the movable member along the rack coupled to the guide member. In another embodiment, the drive mechanism may include a winch arrangement for moving the movable member along the crane boom. In addition to the movable member being actively driven along the crane boom, the control mechanism may also include one or more actuators configured to move the coupling member relative to the movable member in a direction substantially perpendicular to a longitudinal axis of the crane boom.

In one embodiment, the control mechanism includes a first support member coupled to the crane boom and having at least one winch operatively coupled thereto, and a second support member coupled to the crane boom spaced from the first support member and also having at least one winch operatively coupled thereto. The guide member includes at least one guide cable operatively coupled to a winch on each of the first and second support members. In another embodiment, the control mechanism includes a first support member coupled to the crane boom and having at least one winch operatively coupled thereto, and a second support member coupled to the crane boom spaced from the first support member and having at least one sheave operatively coupled thereto. The guide member includes at least one guide cable operatively coupled to a winch on the first support member and the sheave on the second support member. The control mechanism may further include a third support member coupled to the crane boom adjacent the first support member and having at least one winch operatively coupled thereto, wherein the guide cable is also coupled to the winch on the third support member.

In yet a further embodiment, an apparatus for assembling a wind turbine includes a crane boom having a main bearing cable configured to be coupled to a wind turbine component for lifting the component during assembly of the wind turbine, and a control mechanism operatively coupled to the crane boom for controlling the orientation of the wind turbine component during the lift. The control mechanism includes a guide member having a first sheave coupled to the crane boom, a second sheave coupled to the crane boom spaced from the first sheave, and a guide cable extending between the first and second sheaves in a closed loop configuration. The movable member includes a plate member spliced into the guide cable and configured to be movable relative to the crane boom. The coupling member includes a winch spaced from the movable member and a tag line having one end portion operatively coupled to the winch, another end portion operatively coupled to the wind turbine component being lifted by the crane, and an intermediate portion coupled to the plate member.

In still a further embodiment, an apparatus for assembling a wind turbine includes a crane boom having a main bearing cable configured to be coupled to a wind turbine component for lifting the component during assembly of the wind turbine, and a control mechanism operatively coupled to the crane boom for controlling the orientation of the wind turbine component during the lift. The control mechanism includes a guide member having a guide rail coupled to the crane boom and extending along at least a portion thereof. The movable member includes a plate member movably mounted to the guide rail and configured to be movable relative to the crane boom. The coupling member includes a winch spaced from the movable member and a tag line having one end portion operatively coupled to the winch, another end portion operatively coupled to the wind turbine component being lifted by the crane, and an intermediate portion coupled to the plate member. The plate member may include a roller assembly or a slider to facilitate relative movement between the plate member and the guide rail. Additionally, the guide rail may have various cross-sectional shapes including a T-shape, inverted C-shape, or circular.

Additionally, an apparatus for assembling a wind turbine includes a crane boom having a main bearing cable configured to be coupled to a wind turbine component for lifting the component during assembly of the wind turbine, and a control mechanism operatively coupled to the crane boom for controlling the orientation of the wind turbine component during the lift. The control mechanism includes a guide member having a guide cable operatively coupled to a first winch configured to vary the tension in the guide cable and operatively coupled to a second winch that defines a first and second portion of the guide cable. The second winch is configured to vary the lengths of the first and second portions. For example, the lengths may be varied without otherwise affecting the overall length of the guide cable. In one embodiment, the control mechanism includes a first support member coupled to the crane boom and having the first winch coupled thereto and a second support member spaced therefrom and coupled to the crane boom and having a pair of sheaves coupled thereto. A third support member may be provided that is likewise coupled to the crane boom and be adjacent the first support member. The third support member may include the second winch and a pair of sheaves as well. The movable member may include a carriage movably mounted to the guide cables.

A method for assembling a wind turbine using a crane boom having a main bearing cable configured to be coupled to a wind turbine component for lifting the component during assembly includes: i) attaching a coupling member between the wind turbine component and a movable member coupled to the crane boom and movable relative thereto; ii) activating a drive mechanism for moving the movable member relative to the crane boom as the wind turbine component is being lifted by the main bearing cable of the crane boom; and iii) changing the orientation of the wind turbine component using the coupling member.

In one embodiment, activating the drive mechanism may include activating a motor coupled to a gear on the movable member and which cooperates with a rack coupled to the crane boom to move the movable member relative thereto. In another embodiment, a winch arrangement may be used to move the movable member relative to the crane boom. Moreover, the drive mechanisms may be operated such that the movable member is moved so as to be substantially within the same horizontal plane as the wind turbine component being lifted by the main bearing cable of the crane boom.

DETAILED DESCRIPTION

Figure 1:
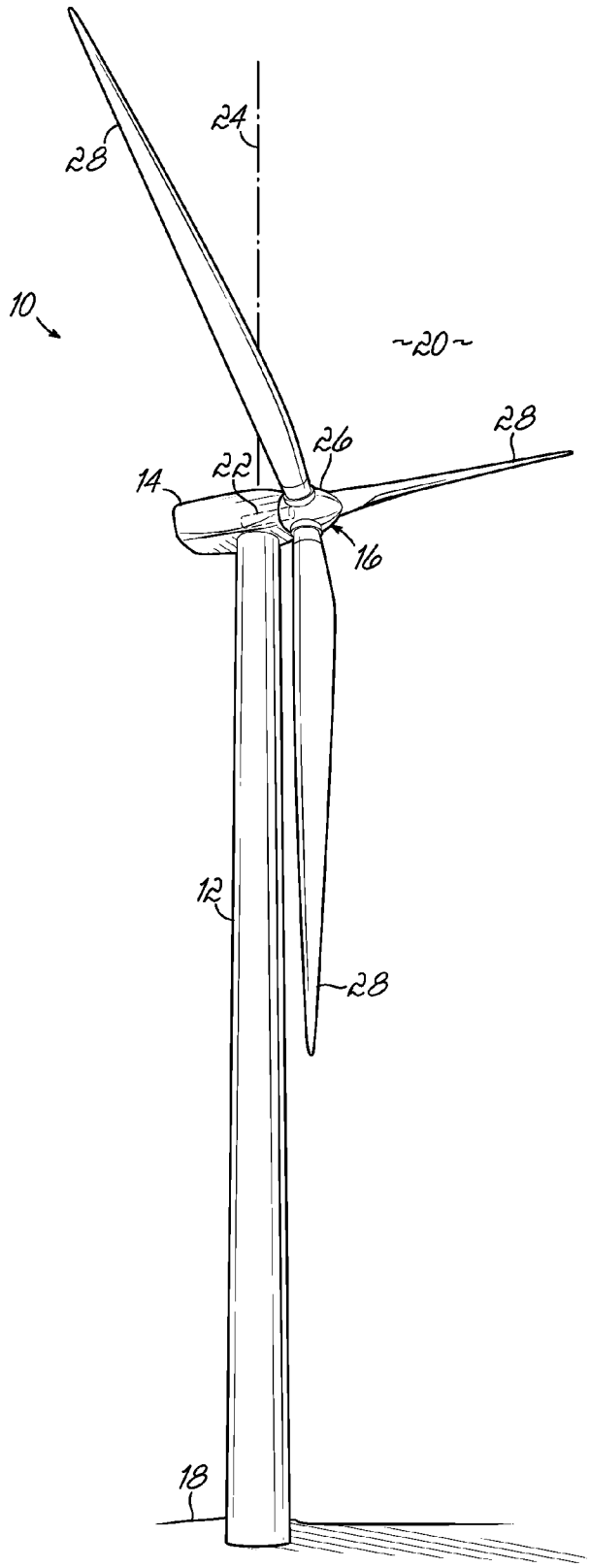
FIG. 1 is a perspective view of an exemplary wind turbine.

Referring now to the drawings and to FIG. 1 in particular, a wind turbine 10 for converting the kinetic energy of the wind into electrical energy includes three main parts; a tower 12, a nacelle 14 mounted on the top of the tower 12, and a rotor 16 operatively coupled to the nacelle 14. The tower 12 is configured as a generally elongated structure extending away from the Earth's surface 18 (such as solid ground or the surface of the ocean, sea or other body of water) so as to locate the rotor 16 at an increased height within the atmosphere 20. Near the Earth's surface 18, wind speeds typically increase with increasing height above the surface 18. Thus, the tower 12 is configured to position the rotor 16 within the faster moving air higher within the atmosphere 20. Additionally, near the Earth's surface 18, the wind becomes generally smoother and less turbulent with increasing height above the surface 18. Therefore, the tower 12 is also configured to locate the rotor 16 within the smoother air higher in the atmosphere 20 and therefore subject the rotor 16 to more consistent and predictable loading. Tower 12 may be formed from tubular steel, concrete, or steel lattice, as is conventional. Those of ordinary skill in the art will recognize, however, that tower 12 may also be formed from other materials and have a wide range of designs and configurations.

The nacelle 14 is typically located adjacent the top of the tower 12 and houses the various components for converting the wind energy into electrical energy, as well as for housing components for operating the wind turbine 10 in an optimal manner. In this regard, the nacelle 14 generally includes a low speed shaft 22 extending from a working end of the nacelle 14 to which the rotor 16 is coupled. The low speed shaft 22 is coupled to a gear box (not shown) whose output is a high speed shaft (not shown) turning at speeds several times higher than the low speed shaft 22. For example, the low speed shaft 22 may be configured to rotate at speeds between approximately 30 revolutions per minute (rpm) and approximately 60 rpm, and the high speed shaft may be configured to rotate at speeds between approximately 1,000 rpm and approximately 1,800 rpm. These values are exemplary and the gear box may be appropriately configured to provide a desirable speed for the high speed shaft. The high speed shaft drives a generator (not shown) housed in the nacelle 14 for producing electrical energy.

In addition, the nacelle 14 may include a yaw drive (not shown) for rotating the nacelle 14 and rotor 16 about a central, substantially vertical axis 24 generally defined by tower 12. The yaw drive allows the rotor 16 to be optimally positioned relative to the direction of the wind. A brake system (not shown) may also be provided in the nacelle 14 to resist or prevent the rotation of the rotor 16. Furthermore, the nacelle 14 may include a control system (not shown) for controlling the operation of the wind turbine 10. Those of ordinary skill in the art may recognize other components or systems which may be housed in nacelle 14 and that facilitate operation of wind turbine 10.

The rotor 16 includes a central hub 26 configured to be coupled to the low speed shaft 22 extending from the working end of nacelle 14. The rotor 16 further includes a plurality of blades 28 (three shown) radially extending from the central hub 26 and configured to interact with the wind to generate lift that causes rotation of the hub 26, and therefore rotation of low speed shaft 22. In some designs, the blades 28 couple to the hub 26 so as to be able to rotate about a longitudinal axis defined by the blades 28. In this way, the angle of the blades 28 relative to the wind direction (referred to as the pitch) may be selectively adjusted to optimize the operation of wind turbine 10. In other designs, the angle that the blades 28 make with the wind may not be adjustable.

In operation, various instrumentation (e.g., anemometer or other suitable instrumentation) may be utilized to measure wind data and determine the optimum position of the rotor 16 relative to the wind. The control system may then be used to actuate the yaw and pitch drives to achieve the optimum position of the blades 28. The wind then rotates the rotor 16, which in turn rotates the low speed shaft 22. The gear box transforms the relatively low rotational speed of the low speed shaft 22 into a relatively high rotational speed of the high speed shaft. The generator then transforms the rotation of the high speed shaft into electrical energy, such as through electromagnetic induction. The electrical energy from wind turbine 10 may then be transmitted to a specific site for use (e.g., house or factory), or transmitted to an electrical grid for use by a larger number of people.

Figure 2:
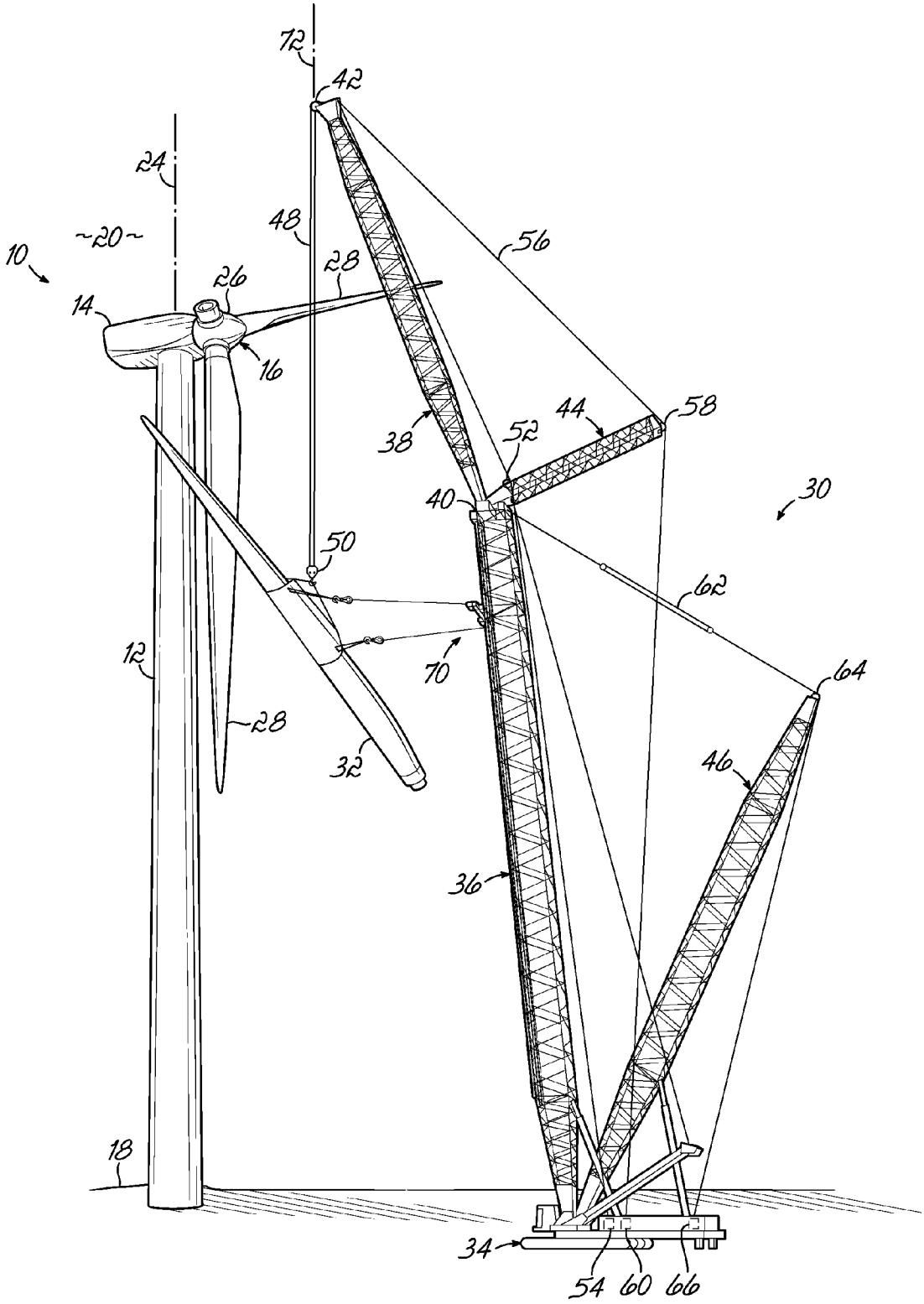
FIG. 2 is a perspective view of a wind turbine during assembly.

As illustrated in FIG. 2, the assembly of wind turbine 10 typically includes the use of a crane 30 for hoisting or lifting the various components of the wind turbine 10 during assembly. By way of example, the crane 30 may be used to position the nacelle 14 on the top of the tower 12, couple the rotor 16 onto the low speed shaft 22 extending from the nacelle 14, couple the blades 28 to the hub 26 (which is already coupled to the nacelle 14), or perform other or combinations of these operations. Thus, while FIG. 2 illustrates the crane 30 lifting a blade 28, it should be realized that the crane 30 may lift different wind turbine components. To emphasize this point, the component being lifted by crane 30 will be referred to herein as load 32.

The crane 30 includes a base 34 that is supported on the ground, platform, etc. (i.e., crane 30 may be configured for land-based use or offshore operations). A main boom 36 is movably coupled to base 34 at a first, lower end thereof and may have, for example, a generally latticed structure as is conventional in the art. A jib boom 38 has a first end that is movably coupled to the second, upper end of the main boom 36, such as at boom point 40. The second end of jib boom 38 includes a main sheave 42 rotatably coupled thereto for receiving the crane's rigging, as will be discussed below. A jib mast 44 may be pivotally coupled to the main boom 36 at boom point 40 and a gantry 46 may also be movably coupled to base 34, the purpose of each being explained below.

The rigging for crane 30 includes a main bearing cable 48 for supporting the load 32 being lifted by crane 30, such as at jib block 50. One end of main bearing cable 48 is connected to the jib boom 38. The other end is trained (i.e., routed or guided) through jib block 50, over main sheave 42 on the second end of jib boom 38, over a second sheave 52 rotatably mounted on the jib mast 44, and connected to a main winch 54 supported on base 34. Winch 54 is capable of reeling in and paying out main bearing cable 48 in a controllable manner to raise and lower load 32.

The rigging also includes a pendant cable 56 having one end connected to the jib boom 38, such as adjacent a second end thereof, and trained over a third sheave 58 rotatably mounted on the jib mast 44, and to a second winch 60 capable of reeling in and paying out pendant cable 56 in a controllable manner to move or adjust the angle of the jib boom 38. The rigging may further include a reeving 62 having an end connected to the main boom 36, such as adjacent a second end thereof, and trained over a fourth sheaving 64 on the gantry 46, and to a third winch 66 for reeling in and paying out reeving 62 in a controllable manner to move or adjust the angle of the main boom 36.

Those of ordinary skill in the art will recognize that all of the above-described components of crane 30 are generally well known in the art and have been described herein to provide a complete description and understanding of aspects and features to be described below. Moreover, the description of crane 30 provided above is exemplary and those of ordinary skill in the art will recognize that the control features described below may be used on a wide range of cranes, and is therefore not limited to the exemplary embodiment described herein.

To enhance the control over the load 32 during a lift, crane 30 includes a control mechanism, generally illustrated at 70. More particularly, in one aspect, control mechanism 70 may be configured to control the orientation of the load 32 relative to a central axis 72, generally defined by a longitudinal axis of the main bearing cable 48, in an improved manner. As discussed in detail below, this may be achieved by defining a moving control point for the tag lines, or other control cables coupled to load 32, generally along the main boom 36 as the load 32 is being lifted.

In a broad sense, the various embodiments disclosed herein include control mechanisms having one or more guide members that extend along at least a portion of the length of the main boom 36. In some embodiments, the guide members may be rigid and fixed members (e.g., guide rails) and in other embodiments, the guide members may be generally flexible and movable (e.g., guide cables). A movable member is operatively coupled to the guide members and configured to move relative to the main boom 36, such movement being guided by the guide members and in a direction generally parallel to a longitudinal axis of the main boom 36. In some embodiments, the movable member may be actively driven along the main boom 36 (e.g., active drive system). In other embodiments, however, the movable member may be moved only as a result of the load 32 being lifted by the main bearing cable 48 (e.g., passive drive systems). Lastly, the control mechanisms disclosed herein include a coupling member that couples the movable member to the load 32. The location where the coupling member couples to the movable member generally defines the control point that facilitates control of load 32 via the control mechanism. In some embodiments, the coupling member may be fixed in length while in other embodiments, the coupling member may be adjustable in length. Several exemplary embodiments of control mechanisms that provide enhanced control of loads 32 for wind turbine construction will now be discussed in detail.

Figure 3A:
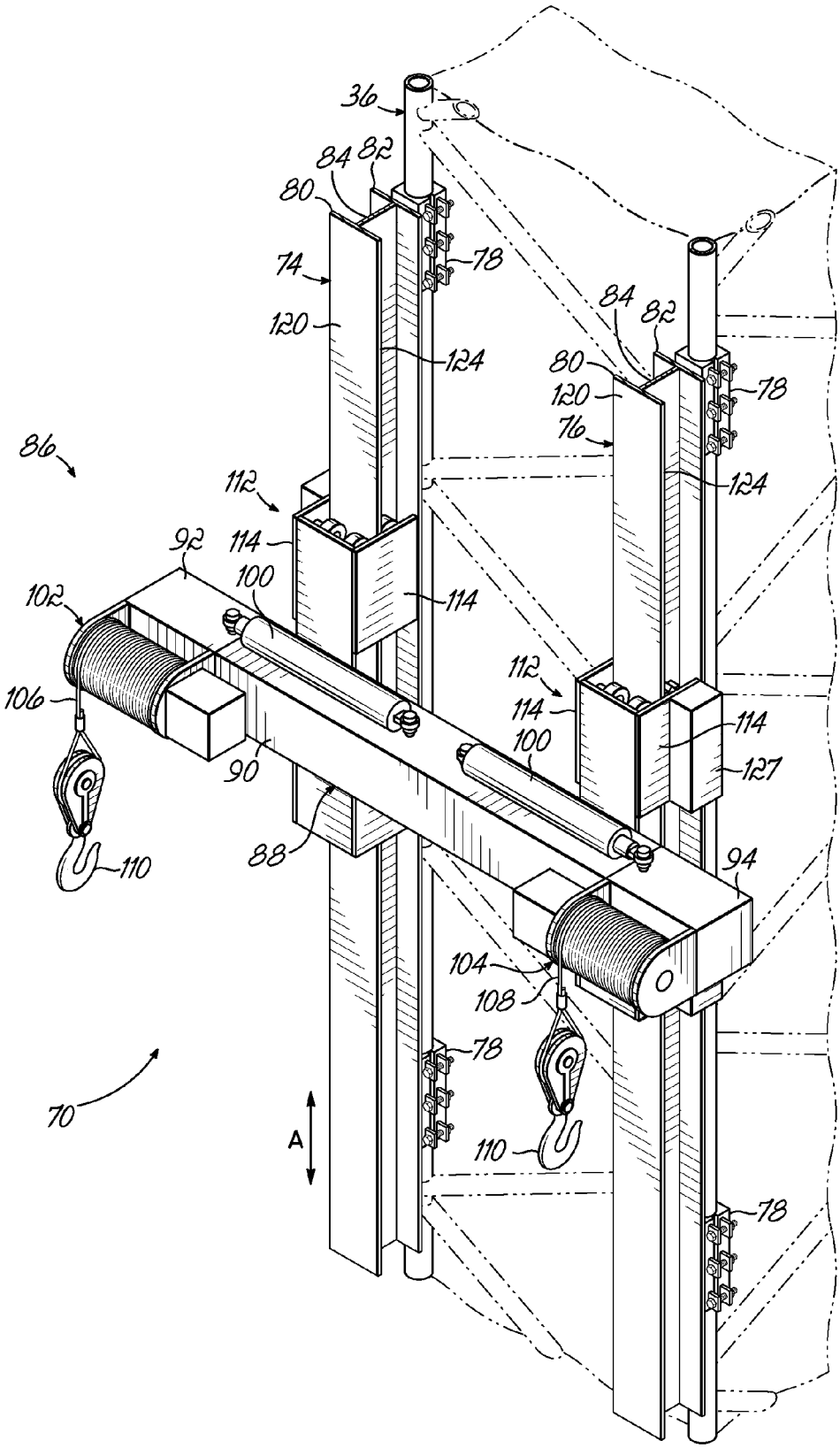
FIG. 3A is a perspective view of a control mechanism in accordance with a first embodiment.
Figure 3B:
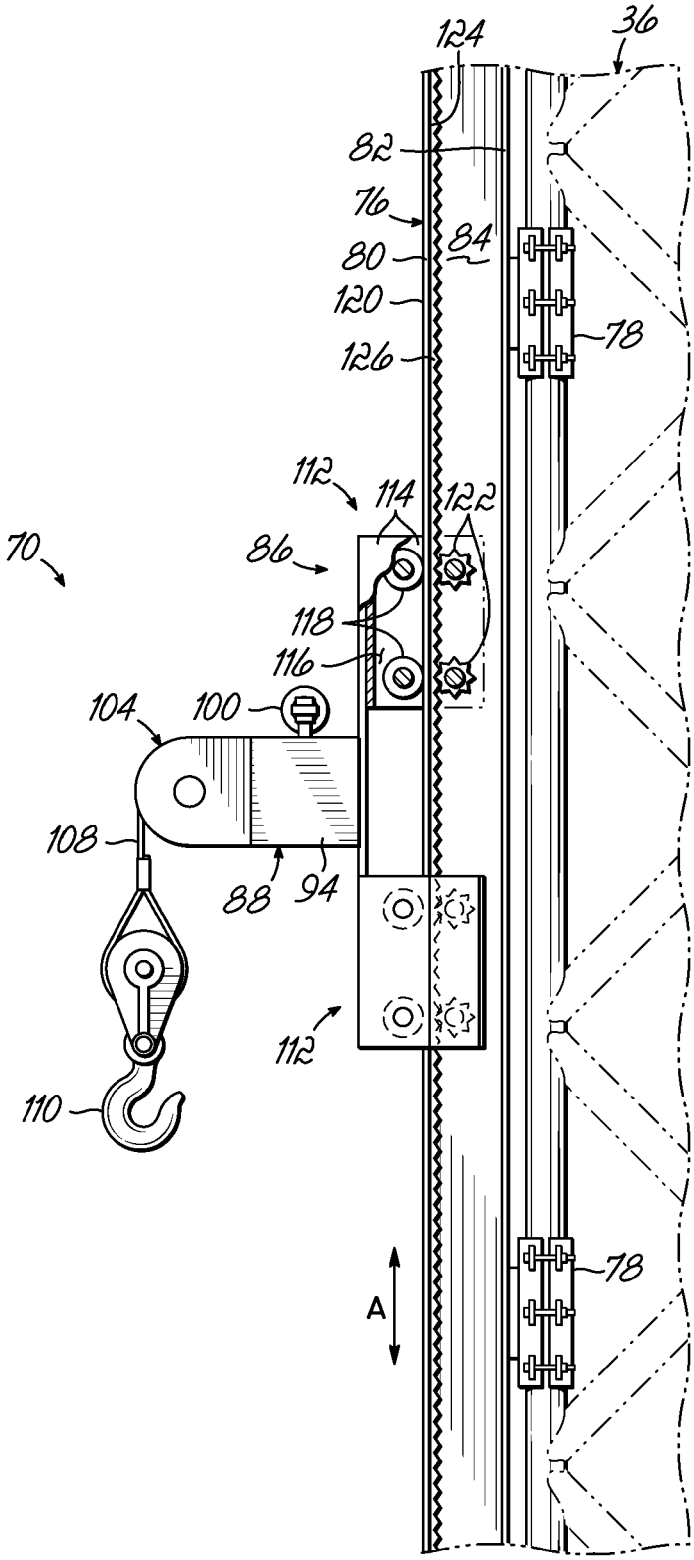
FIG. 3B is a side elevation view of the control mechanism shown in FIG. 3A.
Figure 3C:
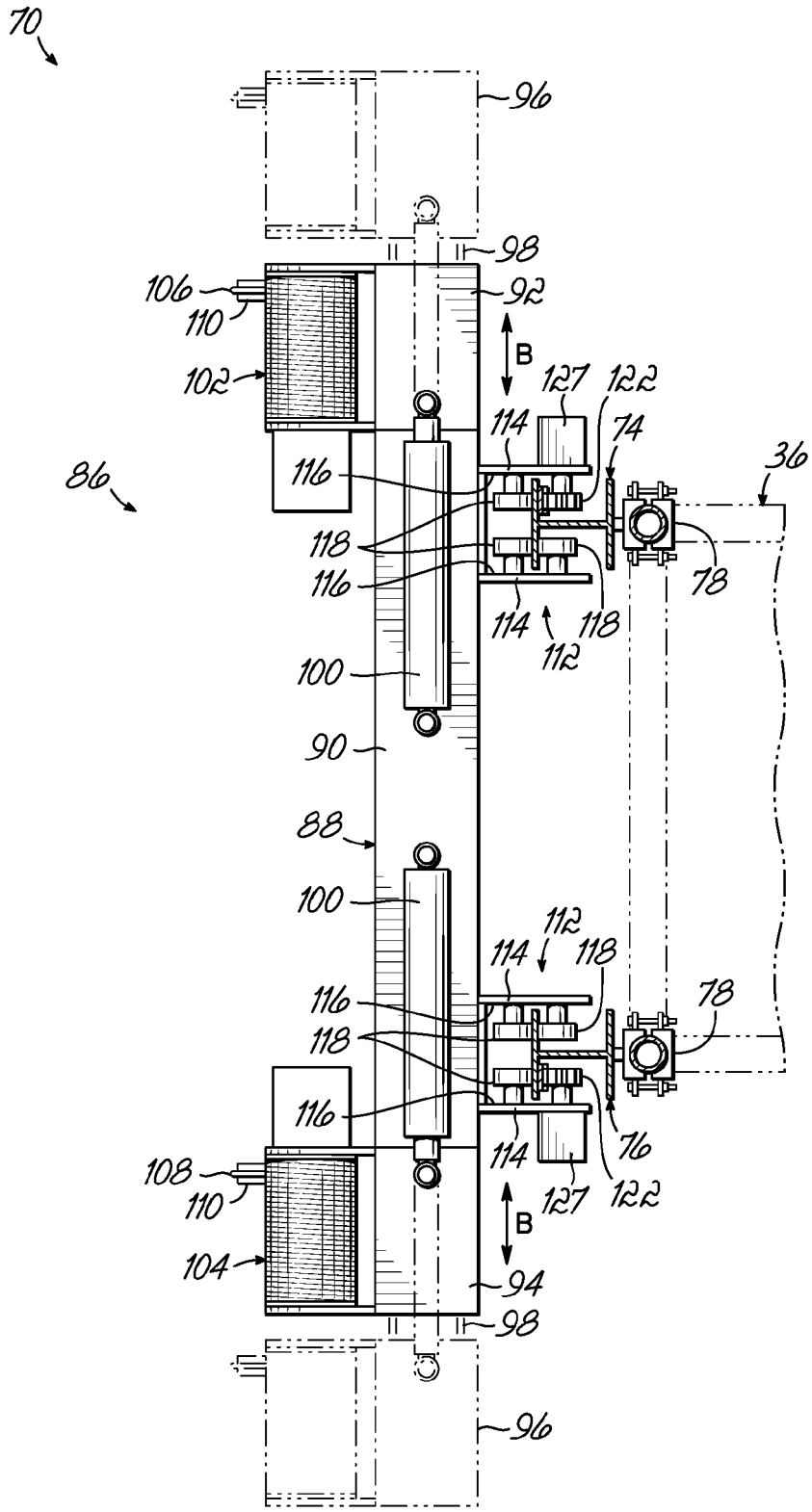
FIG. 3C is a top view of the control mechanism shown in FIG. 3A.

In this regard, and as illustrated in FIGS. 3A-3C, in one embodiment, control mechanism 70 includes a guide member that includes a pair of rails 74, 76 fixedly coupled to the main boom 36 adjacent its working side (e.g., portion facing the load 32 during use) via conventional techniques, including welding, fasteners, such as clamps 78, or other suitable connecting elements. In an exemplary embodiment, the rails 74, 76, may each include I-beams having two opposed flanges 80, 82 coupled by an intermediate web 84 and may be formed from metal or other suitable materials. Control mechanism 70 further includes a movable member that in one embodiment may be configured as a carriage 86 movably mounted to the rails 74, 76 such that carriage 86 may generally move along rails 74, 76 and therefore along main boom 36 as illustrated by arrows A in FIG. 3A.

As best shown in FIGS. 3A and 3C, carriage 86 includes a main support member 88 coupled to each of the rails 74, 76, and having a central portion 90 and opposed end portions 92, 94. Each of end portions 92, 94 includes an external member 96 and an internal member 98 (shown in phantom), which may, for example, be telescopingly received in the ends of central portion 90. Such a telescoping relationship allows the end portions 92, 94 to move or slide laterally outward relative to central portion 90 (shown in phantom in FIG. 3C) as illustrated by arrows B. To facilitate this movement, carriage 86 may include at least one, and preferably a pair of actuators 100 for moving the end portions 92, 94 laterally relative to central portion 90. By way of example, and without limitation, the actuators 100 may include a wide range of pneumatic or hydraulic cylinders. Those of ordinary skill in the art may also recognize other actuators which may be used for this purpose. As will become clear from the discussion below, this configuration allows the lateral distance between the coupling members (e.g., two tag lines) to be selectively adjusted to meet the needs or preferences of a particular application.

Each of the end portions 92, 94 further includes a coupling member that includes a motorized winch 102, 104, respectively, coupled thereto. The coupling member further includes tag lines 106, 108, each having one end thereof operatively coupled to winches 102, 104, respectively. In this way, winches 102, 104 may be configured to reel in and pay out tag lines 106, 108 in a controllable manner. Moreover, winches 102, 104 may be configured to be independently controllable so that tag lines 106, 108 may be reeled in or paid out independent of each other. The other end of tag lines 106, 108 may include a suitable connecting member 110 for coupling the tag lines to the load 32 (such as to a frame, sling, or other holding member that supports the wind turbine component during the lift) as shown in FIG. 2. For example, the connecting member 110 may include a hook for coupling to load 32. However, as recognized by those of ordinary skill in the art, other connecting members are also possible.

The carriage 86 may be coupled to rails 74, 76 in a manner that allows relative movement therebetween. With reference to FIGS. 3B and 3C, in this embodiment, the carriage 86 includes a plurality of roller assemblies 112, each having at least one roller that engages rails 74, 76 to facilitate movement therealong. In this regard, each roller assembly 112 includes opposed support plates 114, each coupled to the central portion 90 of support member 88 and each defining confronting interior surfaces 116. One or more rollers 118 may be coupled to each of the interior surfaces 116 of plates 114 and extend inwardly thereof. When the roller assembly 112 is coupled to the rails 74, 76, the rollers 118 may be configured to engage and roll along an exterior surface 120 of flange 80.

Additionally, the carriage 86 may include a drive mechanism for actively moving the carriage 86 along main boom 36. In this regard, and in one embodiment, the drive mechanism may include at least one gear 122 coupled to an interior surface 116 of plates 114 and which extends inwardly thereof. When the roller assembly 112 is coupled to the rails 74, 76, the gear 122 may be configured to engage an interior surface 124 of flange 80. In this way, the roller assembly 112 cannot be pulled away from rails 74, 76, but allows motion of carriage 86 therealong. The drive mechanism may further include at least one rack 126 coupled to interior surface 124 and extending for a substantial portion of the length of rails 74, 76. As recognized by those of ordinary skill in the art, the at least one gear 122 and the at least one rack 126 cooperate to move the carriage 86 along the main boom 36. To this end, the at least one gear 122 may be operatively coupled to a motor 127 for rotating the gear 122 and driving the carriage 86 along main boom 36. For example, the motor 127 may be an electric or hydraulic motor coupled to the one or more drive gears 122. Other types of motors may also be used to drive the carriage 86.

In one embodiment (not shown), two racks 126 may be provided on the interior surface 124 of each rail 74, 76 (e.g., a rack 126 disposed on both sides of intermediate web 84), and corresponding gears 122 may be provided to cooperate with each rack 126. Alternatively, for each rail 74, 76, only one rack 126 may be provided on the interior surface 124 (e.g., on either side of intermediate web 84) and a corresponding drive gear 122 provided. In this case, rollers 118 are used instead of gears 122 when there is to be no cooperation with a rack 126. Such an embodiment is illustrated in FIGS. 3A-3C, with the rack 126 being located on the outward portion of interior surface 124 (FIG. 3C). In another alternative embodiment (not shown), only one rack 126 is provided on either rail 74 or 76 for driving the carriage 86 along main boom 36. Additionally, in one embodiment, each of the gears 122 may be driven by a motor. Alternatively, however, less than all the gears 122 may be driven by a corresponding motor. For example, in one embodiment, only one motor driven gear may be provided on each of rails 74, 76 as shown in the figures. In still another embodiment (not shown), only one driven gear may be provided for both rails 74, 76. Depending on the specific application, those of ordinary skill in the art will recognize how to configure the drive mechanism to meet the needs of the specific application.

In operation, the main bearing cable 48 may be paid out (i.e., let out or slackened) to locate the jib block 50 adjacent the ground or support surface so as to couple the jib block 50 to the load 32. In this initial position of main bearing cable 48, the carriage 86 may be positioned adjacent the first, lower end of the main boom 36. The motorized winches 102, 104 may be activated to pay out tag lines 106, 108 so that the connecting member 110 may be coupled to the load 32. As the load 32 is initially lifted off the ground, the winches 102, 104 may be activated to impose a suitable tension in tag lines 106, 108.

The main winch 54 may be activated to reel in the main bearing cable 48 and raise the load 32 upwardly into the atmosphere 20. As the load 32 is being raised, the drive mechanism (e.g., rack(s) 126, gear(s) 122, motor(s) 127, etc.) may be activated to move the carriage 86 along main boom 36 toward the second, upper end thereof. More particularly, because in this embodiment the carriage 86 is actively driven, the carriage 86 may be moved along main boom 36 in a manner that maintains a specified relation between the carriage 86 and load 32. By way of example, in one embodiment, as the load 32 is being raised by main bearing cable 48, the carriage 86 may be driven along main boom 36 so that the carriage 86 and load 32 lie generally within the same horizontal plane (e.g., both have substantially the same height relative to the ground or support surface). Other relationships between the carriage 86 and the load 32 are also possible, such as maintaining a fixed vertical distance between the carriage 86 and load 32 during the lift.

Additionally, depending of the angle of the main boom 36 and/or jib boom 38, the winches 102, 104 may be activated to maintain the tension in the tag lines 106, 108 as the load 32 is being raised. Maintaining the tension in tag lines 106, 108 stabilizes the load 32 during the lift, maintains the orientation of the load 32 relative to central axis 72 (e.g., the tag lines 106, 108 prevent the load 32 from rotating about central axis 72), and maintains movement of the load 32 in a generally vertical direction along central axis 72. Those of ordinary skill in the art will recognize how to activate winches 102, 104 to maintain the tension in tag lines 106, 108 and provide the desired movement of load 32 during the lift.

When the load 32 is raised to a sufficient height, such as adjacent the top of tower 12 (FIG. 1), it may be desirable to vary the orientation of the load 32 to facilitate assembly of the component to the wind turbine 10. To this end, the winches 102, 104 may be activated to vary the orientation of the load 32. More particularly, to rotate the load 32 about central axis 72 in a first direction (e.g., clockwise direction), one of the winches 102, 104 may be activated so as to pay out, and thereby lengthen, one of tag lines 106, 108, while the other of winches 102, 104 may be activated so as to reel in, and thereby shorten, the other of tag lines 106, 108. To rotate the load 32 about the central axis 72 in a second direction (e.g., counterclockwise), the winches 102, 104 may be operated in the opposite manner. Once the proper orientation of the load 32 has been achieved, assembly workers on the tower 12 may secure the component to the wind turbine 10 and uncouple the tag lines 106, 108 and main bearing cable 48 from the load 32. The crane 30 may then be used to raise another component for further assembly of wind turbine 10.

The control mechanism 70 described above addresses many of the drawbacks with apparatus and techniques used in existing wind turbine construction. More particularly, control mechanism 70 enhances control over a wind turbine component being lifted by a crane. In this regard, because the carriage 86, which carries the winches 102, 104 and tag lines 106, 108, is capable of moving along the main boom 36, the inclination angle between the horizontal plane of the load 32 and the tag lines 106, 108 is reduced. For example, in contrast to having the tag lines 106, 108 generally perpendicular to the horizontal plane of the load (as in manual tag line techniques), the tag lines 106, 108 may be generally parallel to the horizontal plane of load 32. More particularly, because the carriage 86 is actively driven, the tag lines 106, 108 may lie generally within the same horizontal plane as load 32, although other arrangements are possible.

As discussed above, maintaining the tag lines 106, 108 to be generally parallel to the horizontal plane of load 32 provides improved control of the load 32. More particularly, the ability to rotate the load 32 about central axis 72 becomes much easier when such a parallel configuration exists. In this regard, when the tag lines 106, 108 and the horizontal plane of the load 32 are generally parallel, a substantial portion of the force applied to the tag lines 106, 108 has a horizontal component, and therefore is utilized to rotate the load 32. This is in contrast to manual tag lines, wherein a substantial portion of the force applied to the tag lines has a vertical component, and therefore works against the main bearing cable, and only a small portion of the applied force is utilized to rotate the load about its central axis.

Additionally, because the carriage 86 and tag lines 106, 108 move along the main boom 36, the distance between the control point for the tag lines 106, 108 (e.g., where the winches 102, 104 couple to support member 88) and the load 32 is reduced. As discussed above, minimizing the distance between the control point of the tag lines 106, 108 and the load 32 provides improved control of the load 32. In this regard, as the main boom 36 and/or the jib boom 38 are typically angled in use, the distance between the control point of the tag lines 106, 108 and the load 32 may decrease as the load 32 is raised vertically. Accordingly, control increases as the load 32 is being raised such that it may be considered at a maximum when the load 32 is adjacent the top of the tower 12. This is in contrast to manual tag line techniques wherein the distance between the control point of the tag lines and the load are at a maximum, and control is therefore at a minimum, when the load is adjacent the top of the tower.

The control mechanism 70 as described above may provide additional benefits to wind turbine construction. For example, because of the increased control afforded by control mechanism 70, it is believed that wind turbine assembly may be initiated in a wider range of environmental conditions. In this regard, it is believed that construction may occur in wind speeds of approximately 15 m/s or even higher. This increased capability will increase the number of days available for wind turbine assembly to occur. Moreover, allowing assembly to occur in a wider range of environmental conditions will also ease the burden and cost of coordinating and scheduling equipment and personnel necessary for the construction.

Furthermore, it is contemplated that the benefits afforded by control mechanism 70 will reduce the number of personnel needed for wind turbine assembly. More particularly, ground personnel dedicated to controlling the load as it is being raised may be reduced or eliminated. Moreover, control mechanism 70 may also provide more centralized control over the load being raised by the crane. In this regard, control over the winches 102, 104, tag lines 106, 108, and the drive mechanism for controlling the movement of carriage 86 along main boom 36 may reside in fewer people as compared to manual tag line techniques. For example, in one embodiment, the crane operator may control the winches 102, 104, tag lines 106, 108, and the drive mechanism (as well as the main bearing cable). However, those of ordinary skill in the art may recognize other arrangements that may provide a more centralized control system as compared to manual tag line techniques.

Figure 4:
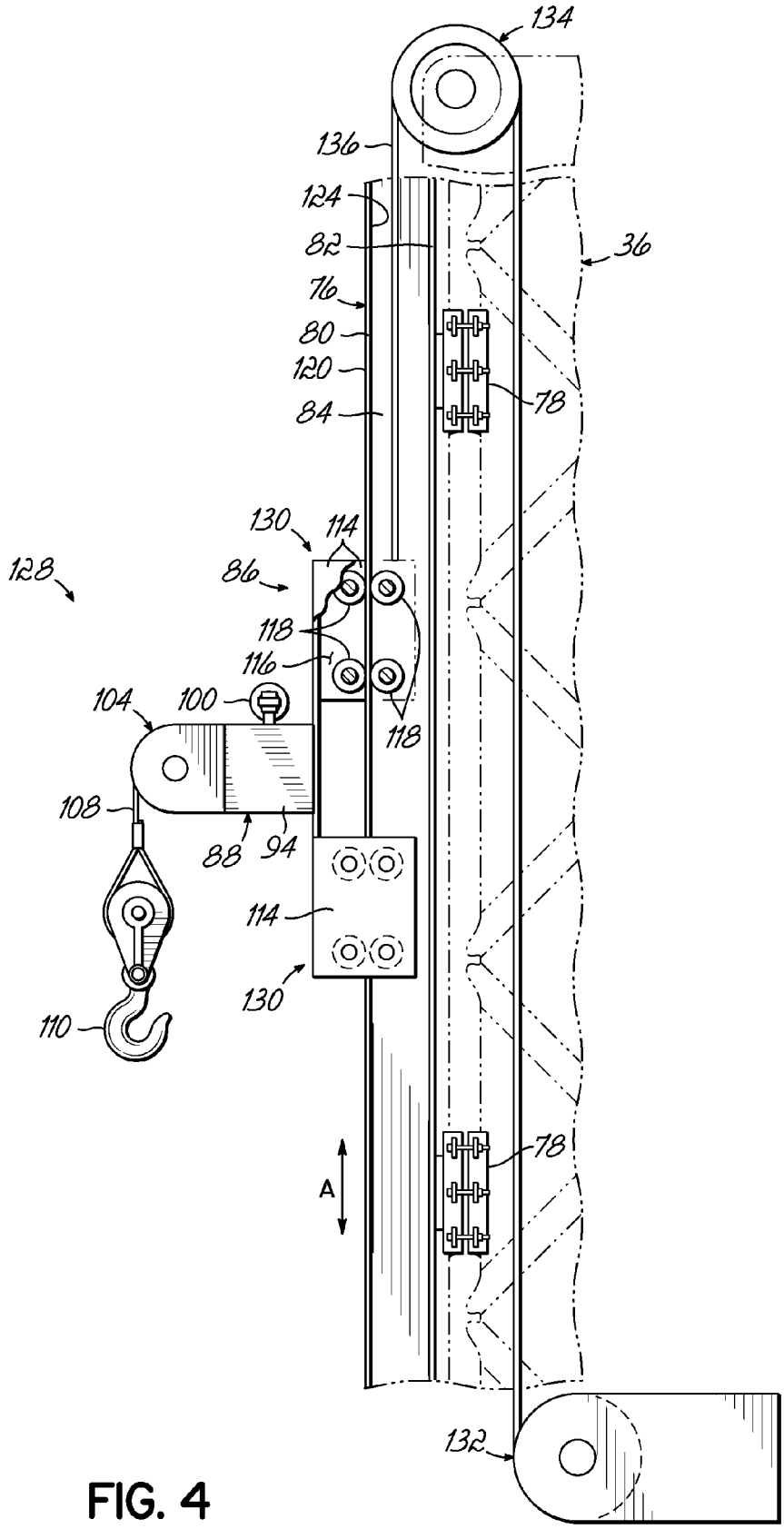
FIG. 4 is a side elevation view of a control mechanism in accordance with a second embodiment.

Another embodiment in accordance with aspects of the invention is shown in FIG. 4. This embodiment is similar to that shown in FIGS. 3A-3C and thus, like reference numerals are used to refer to like features in these figures. However, one primary difference between these two embodiments is directed to the particular control mechanism for controlling the load 32 being lifted by the crane 30. More particularly, the embodiment in FIG. 4 includes a control mechanism 128 having a different drive mechanism for moving the carriage 86 along main boom 36. In this regard, to actively drive the carriage 86 along main boom 36, a winch arrangement is utilized as part of the drive mechanism instead of the rack/gear arrangement of the previous embodiment.

The winch arrangement shown in FIG. 4 has a control mechanism 128 with a drive mechanism that includes at least one drive winch 132 coupled to the crane 30 adjacent its base 34. By way of example, the drive winch 132 may be coupled to the base 34, the main boom 36, or at least one of rails 74, 76. The drive mechanism further includes a drive sheave 134 coupled to the crane 30 adjacent the second, upper end of the main boom 36. By way of example, the drive sheave 134 may be rotatably mounted to the main boom 36, or at least one of rails 74, 76. A drive cable 136 has a free end coupled to the carriage 86 and is trained over the drive sheave 134 to drive winch 132, which is capable of reeling in and paying out drive cable 136 in a controllable manner. Similar to the previous embodiment, the carriage 86 includes a plurality of roller assemblies 130 for movably coupling to rails 74, 76. The roller assemblies 130 are similar in construction to roller assemblies 112, but that rollers 118 are used instead of gears 122.

Operation of this embodiment is similar to that described previously for FIGS. 3A-3C. Thus, for sake of brevity, a detailed explanation of the operation of this embodiment will be omitted. The primary difference is that instead of activating motor(s) 127, drive winch 132 may be activated to reel in drive cable 136 so as to move carriage 86 toward the second end of main boom 36. Those of ordinary skill in the art will readily recognize how to operate control mechanism 128 based on the explanation above in regard to FIGS. 3A-3C. Additionally, the embodiment shown in FIG. 4 may have benefits similar to those described above for the previous embodiment.

Other embodiments exist for controlling a wind turbine component during a crane lift that may provide benefits in certain applications. By way of example, in some applications, it may be desirable to minimize the forces acting on the main boom in a direction other than along the length of the main boom. In the embodiments described above, the control mechanisms included a pair of generally rigid rails to which a carriage was movably coupled. The carriage, in turn, carried the winches that controlled the tag lines. Accordingly, the forces on the main boom 36, as a consequence of the arrangement of control mechanisms 70 and 128, may include a force component in a direction perpendicular to the longitudinal axis of the main boom 36. To address such a scenario, a control mechanism is described below that not only provides enhanced control of the load during a crane lift, but also reduces the forces acting generally perpendicular to the longitudinal axis of the main boom of the crane.

Figure 5A:
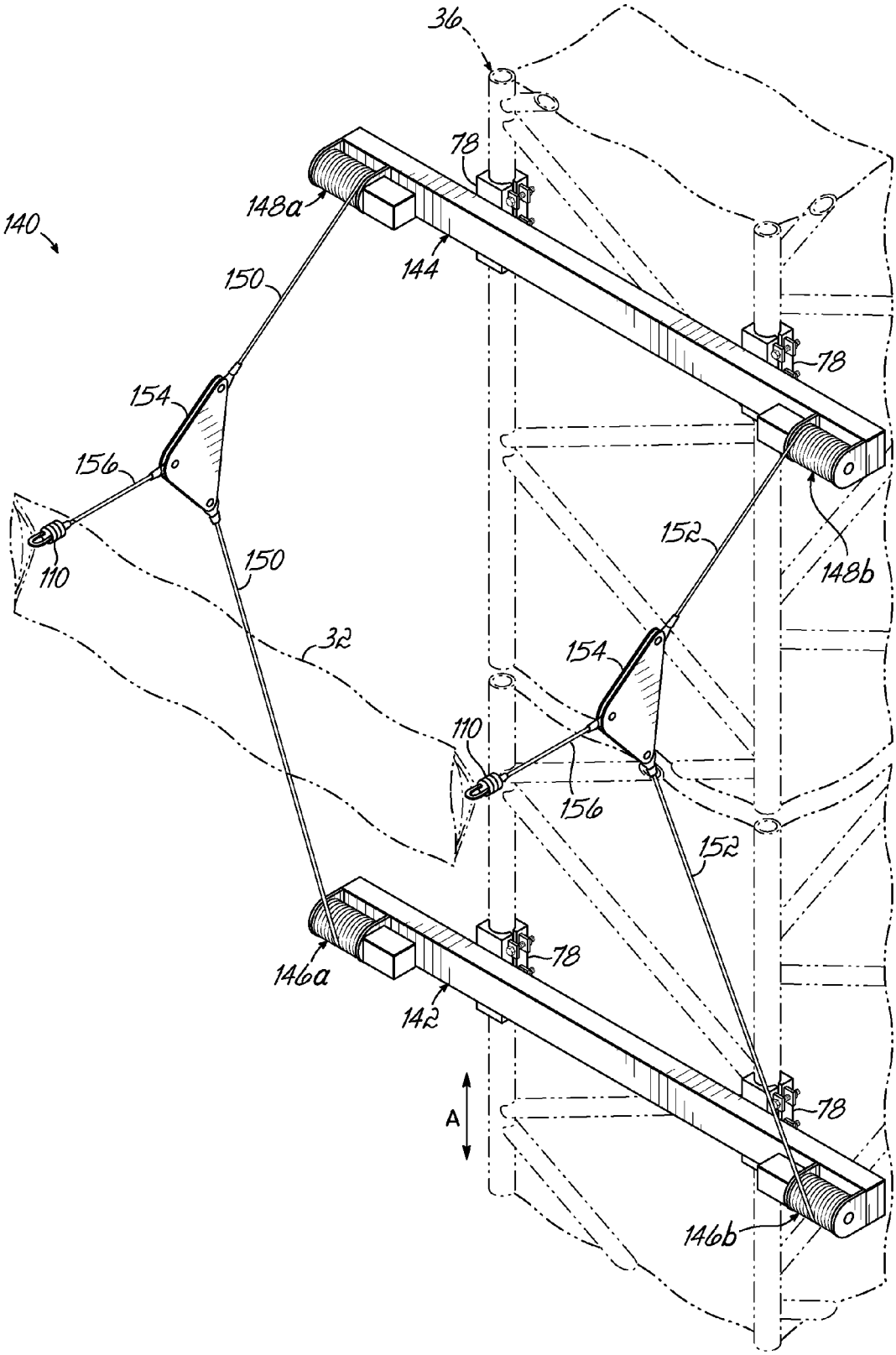
FIG. 5A is a perspective view of a control mechanism in accordance with a third embodiment.
Figure 5B:
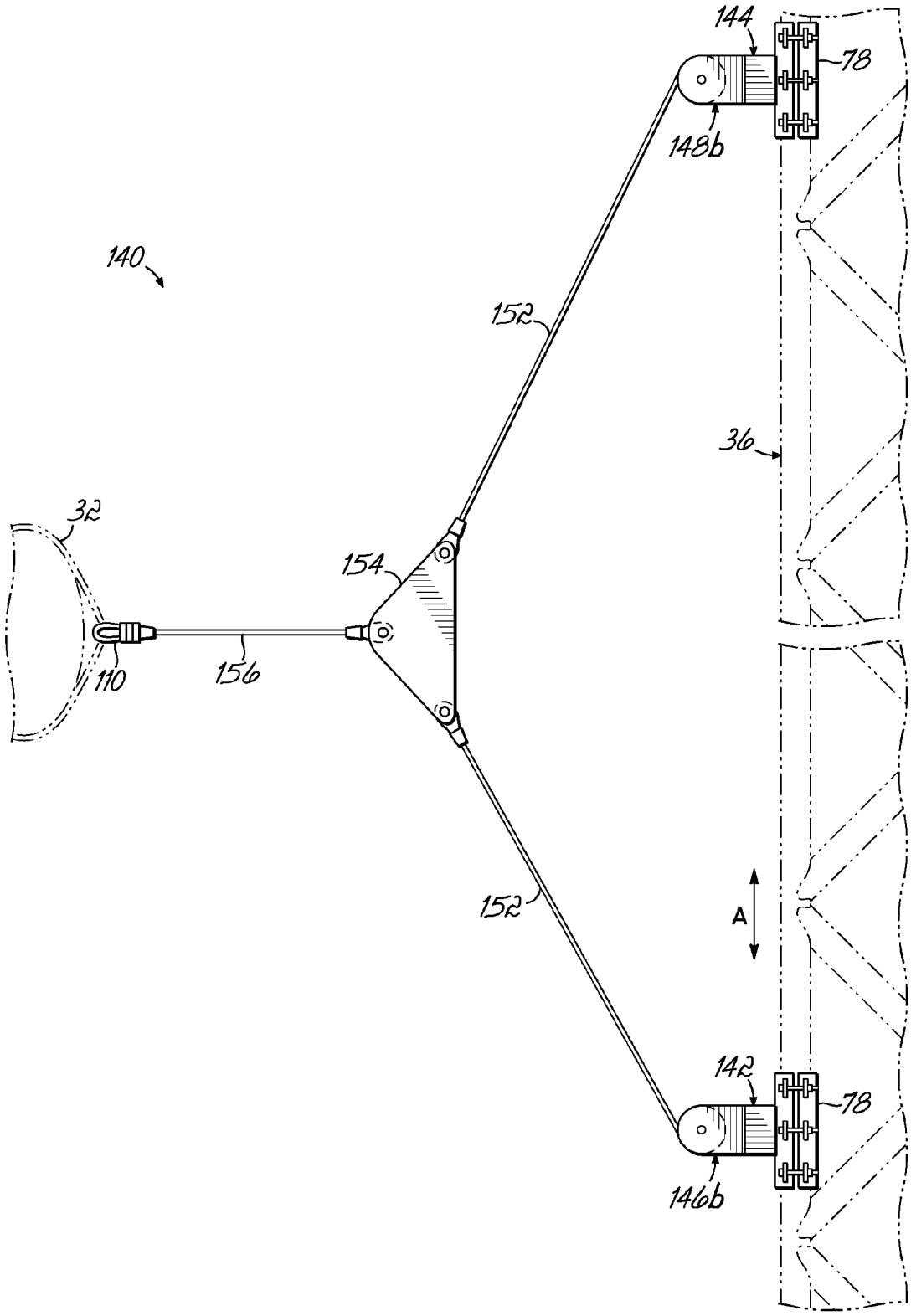
FIG. 5B is a side elevation view of the control mechanism shown in FIG. 5A.
Figure 5C:
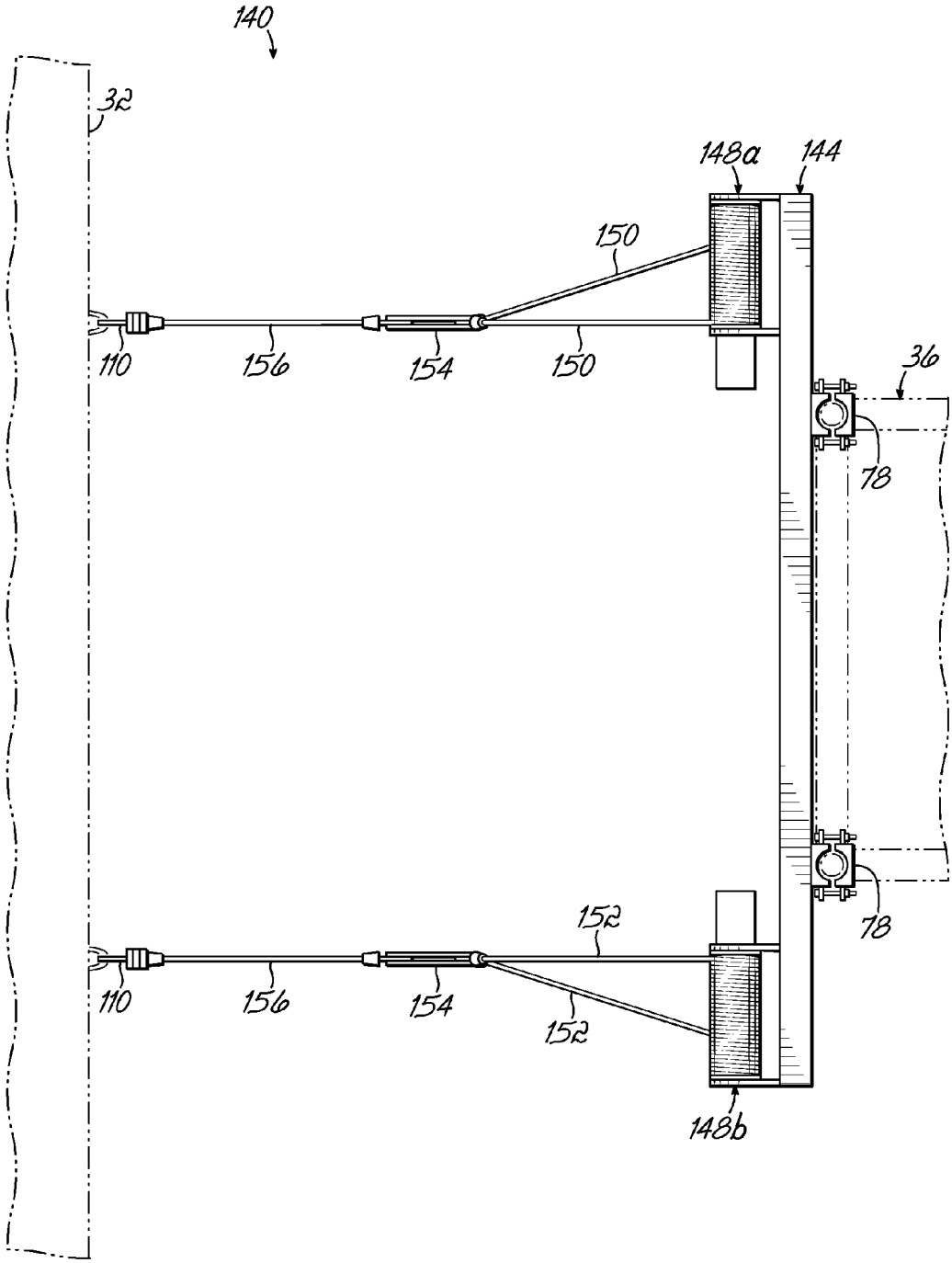
FIG. 5C is a top view of the control mechanism shown in FIG. 5A.

In this regard, another exemplary control mechanism is shown in FIGS. 5A-5C, in which like reference numerals refer to like features shown in FIGS. 1 and 2. In this embodiment, crane 30 includes a control mechanism 140 configured to control, for example, the orientation of the load 32 relative to the central axis 72 in an improved manner. As discussed in detail below, this may be achieved by defining a moving control point for the tag lines, or other control cables coupled to load 32, generally along the main boom 36 as the load 32 is being lifted.

As illustrated in these figures, control mechanism 140 includes a guide member that includes a pair of guide cables coupled to and extending along main boom 36. In this regard, control mechanism 140 includes a first support member 142 coupled to the main boom 36 adjacent its first, lower end, and a second support member 144 coupled to the main boom 36 adjacent its second, upper end. The first and second support members 142, 144 extend in a direction generally perpendicular to the longitudinal axis generally defined by the main boom 36 and may be coupled thereto via conventional techniques, including welding, fasteners, such as clamps 78, or other suitable connecting elements. In one embodiment, the first support member 142 includes a pair of winches 146*a*, 146*b* coupled thereto and in spaced relation therealong, such as adjacent opposed ends thereof. The second support member 144 similarly includes a pair of winches 148*a*, 148*b* coupled thereto and in spaced relation therealong, such as adjacent opposed ends thereof. Although not limited to such a configuration, winches 146*a*, 148*a* and winches 146*b*, 148*b* may be arranged so as to generally align with each other in a generally parallel manner relative to the longitudinal axis of main boom 36.

A pair of guide cables 150, 152 extends along the main boom 36 between the first and second support members 142, 144. One end of guide cable 150 is operatively coupled to winch 146*a* and the other end of guide cable 150 is operatively coupled to winch 148*a*. Winches 146*a*, 148*a* are independently controllable and capable of reeling in and paying out guide cable 150 in a controllable manner. In a similar manner, one end of guide cable 152 is operatively coupled to winch 146*b* and the other end of guide cable 152 is operatively coupled to winch 148*b*. Winches 146*b*, 148*b* are also independently controllable (and independently controllable relative to winches 146*a*, 148*a*) and capable of reeling in and paying out guide cable 152 in a controllable manner.

Control mechanism 140 further includes a movable member that in one embodiment may include separate plate members 154 coupled to each of guide cables 150, 152. In one embodiment, the plate members 154 may be spliced directly into cables 150, 152 (i.e., incorporated between or joining segments of cables 150, 152) such that ends of cables 150, 152 couple to eyelets or apertures in plate members 154, such as at two corners thereof. In this way, the plate members 154 move along main boom 36 through movement of guide cables 150, 152. Those of ordinary skill in the art will recognize other arrangements for coupling plate members 154 to cables 150, 152, including welding, or other suitable fasteners. Those of ordinary skill in the art will further recognize that the plate members 154 are not limited to the triangular configuration shown, but that other shapes and designs for plate members 154 are also possible.

The control mechanism 140 further includes a coupling member having a fixed length cable 156 having one end coupled to, for example, an eyelet or aperture formed in the plate members 154 (such as at the remaining corner thereof). The other end of the fixed cable 156 is configured to be coupled to load 32. In this regard, this end of fixed cable 156 may include a suitable connecting member 110, such as, for example, a hook, to couple the fixed cable 156 to load 32 (such as to a frame, sling, or other holding member that supports the wind turbine component during the lift). Other connecting members, however, are also possible.

Similar to the previous embodiment, in operation, the main bearing cable 48 may be paid out to locate the jib block 50 adjacent the ground or support surface so as to couple the jib block 50 to the load 32. In this initial position of main bearing cable 48, the plate members 154 of guide cables 150, 152 may be positioned adjacent the first, lower end of main boom 36. The motorized winches 146*a*, 146*b*, 148*a*, 148*b* may be activated to pay out the guide cables 150, 152 so that the hook or other connecting member 110 on fixed cable 156 may be coupled to the load 32. For example, at least one of winches 146*a*, 148*a* and at least one of winches 146*b*, 148*b* may be activated to pay out guide cables 150, 152, respectively. As the load 32 is initially lifted off the ground, the winches 146*a*, 146*b*, 148*a*, 148*b* may be activated to impose a suitable tension in guide cables 150, 152. For example, at least one of winches 146*a*, 148*a* and at least one of winches 146*b*, 148*b* may be activated to reel in guide cables 150, 152, respectively.

The main winch 54 may be activated to reel in the main bearing cable 48 and raise the load 32 upwardly and into the atmosphere 20. As the load 32 is being raised, the drive mechanism (e.g., winches 146*a,b*, 148*a,b* and guide cables 150, 152) may be suitably activated to move the plate members 154 and fixed cables 156 along main boom 36 toward the second, upper end thereof. More particularly, because the control mechanism 140 is an active drive system, the plate members 154 (and fixed cables 156) may be moved along main boom 36 in a manner that maintains a specified relation between the plate members 154 and load 32. By way of example, in one embodiment, as the load 32 is being raised by main bearing cable 48, the plate members 154 may be driven along main boom 36 so that the plate members 154 and load 32 lie generally within the same horizontal plate (e.g., both have substantially the same height relative to the ground or support surface). To achieve such a relationship, the winches 146*a*, 146*b*, 148*a*, 148*b* may be activated in coordination with each other. More particularly, winches 148*a*, 148*b* may be reeled in while winches 146*a*, 146*b* are paid out. Other relationships between the plate members 154 and load 32 are also possible, such as maintaining a fixed vertical distance between the plate members 154 and load 32 during the lift.

Additionally, depending of the angle of the main boom 36 and/or jib boom 38, the winches 146*a*, 146*b*, 148*a*, 148*b* may be activated to maintain the tension in the guide cables 150, 152. Maintaining the tension in guide cables 150, 152 stabilizes the load 32 during the lift, maintains the orientation of the load 32 relative to central axis 72 (e.g., the guide cables 150, 152 prevent the load 32 from rotating about central axis 72), and maintains movement of the load 32 in a generally vertical direction along central axis 72. Those of ordinary skill in the art will recognize how to activate winches 146*a*, 146*b*, 148*a*, 148*b* to maintain the tension in guide cables 150, 152 and provide the desired movement of load 32 during the lift. For example, winches 148*a*, 148*b* may reel in guide cables 150, 152 at a faster rate, a slower rate, or the same rate than winches 146*a*, 146*b* are paying out guide cables 150, 152, depending on the desired movement of load 32.

When the load 32 is raised to a sufficient height, such as adjacent the top of tower 12 (FIG. 1), it may be desirable to vary the orientation of the load to facilitate assembly of the component to the wind turbine 10. To this end, the winches 146*a*, 146*b*, 148*a*, 148*b* may be activated to vary the orientation of the load 32. More particularly, to rotate the load 32 about central axis 72 in a first direction (e.g., clockwise direction), one of the guide cables 150, 152 may be paid out while the other of guide cable 150, 152 may be reeled in. This may be achieved by suitably activating winches 146*a*, 146*b*, 148*a*, 148*b*. More particularly, winches 146*a*, 146*b*, 148*a*, 148*b* may be activated in a manner that lengthens one of guide cables 150, 152 and shortens the other of guide cables 150, 152 without significantly changing the height of plate members 154. To rotate the load 32 about the central axis 72 in a second direction (e.g., counterclockwise), the other of winches 146*a*, 146*b*, 148*a*, 148*b* may be operated in an opposite manner. Once the proper orientation of the load 32 has been achieved, assembly workers on the tower 12 may secure the component to the wind turbine 10 and uncouple the fixed cables 156 and main bearing cable 48 from the load 32. The crane 30 may then be used to raise another component for further assembly of wind turbine 10.

Although control mechanism 140 has a slightly different design and operation as compared to control mechanisms 70, 128 described above, it is believed that control mechanism 140 also addresses many of the drawbacks of existing apparatus and techniques and provides many of the same benefits as those provided by control mechanisms 70, 128, as has been described above.

An alternative embodiment, similar to that shown in FIGS. 5A-5C, includes a different winch arrangement for moving the guide cables 150, 152 (and thus the plate members 154) along the main boom 36. More particularly, the winch arrangement may be configured to locate the winches adjacent the first, lower end of the main boom 36. Such an arrangement makes the winches more accessible and positions the relatively heavy, operative components lower on main boom 36, thus potentially enhancing stability of crane 30.

Figure 6A:
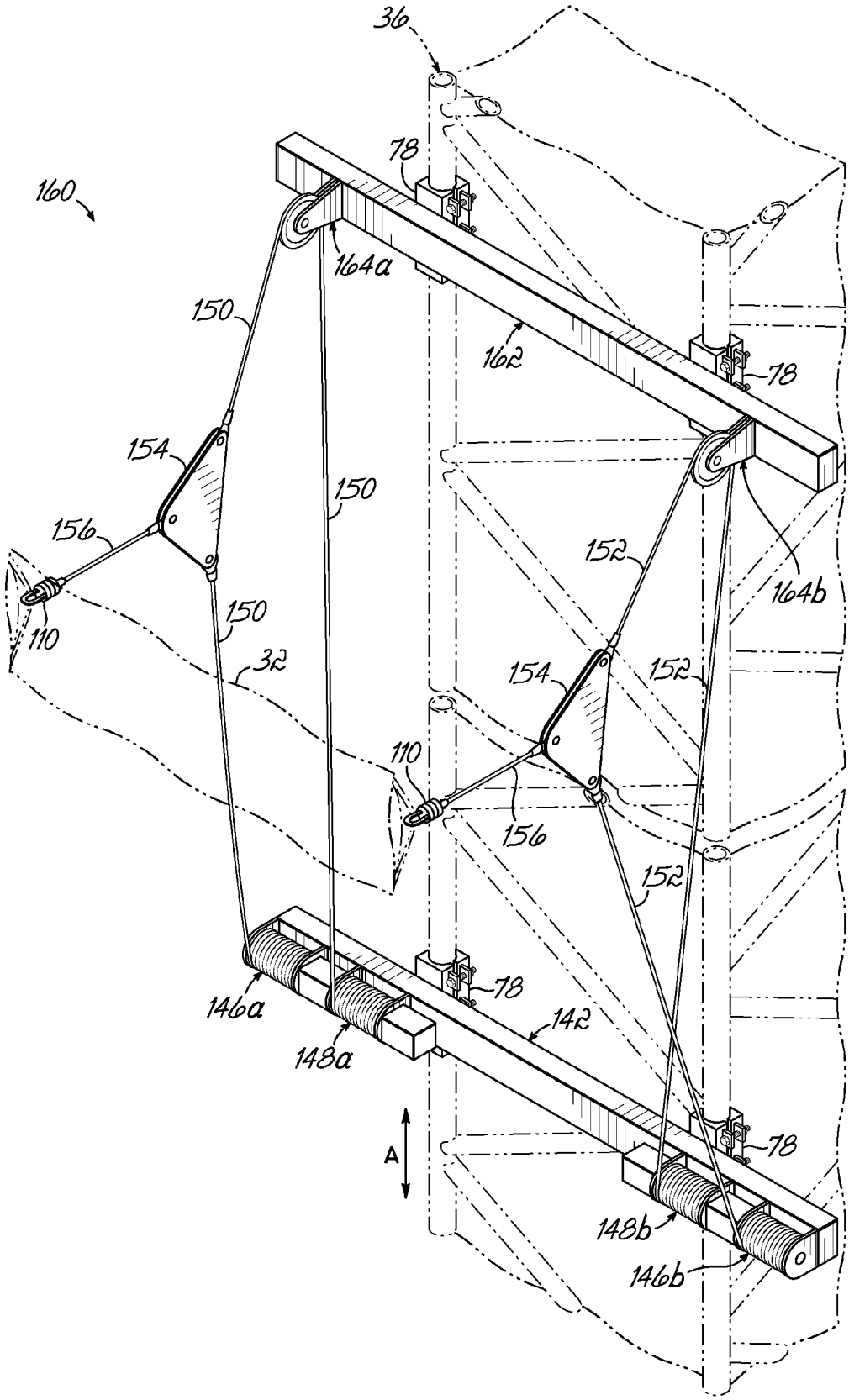
FIG. 6A is a perspective view of a control mechanism in accordance with a fourth embodiment.
Figure 6B:
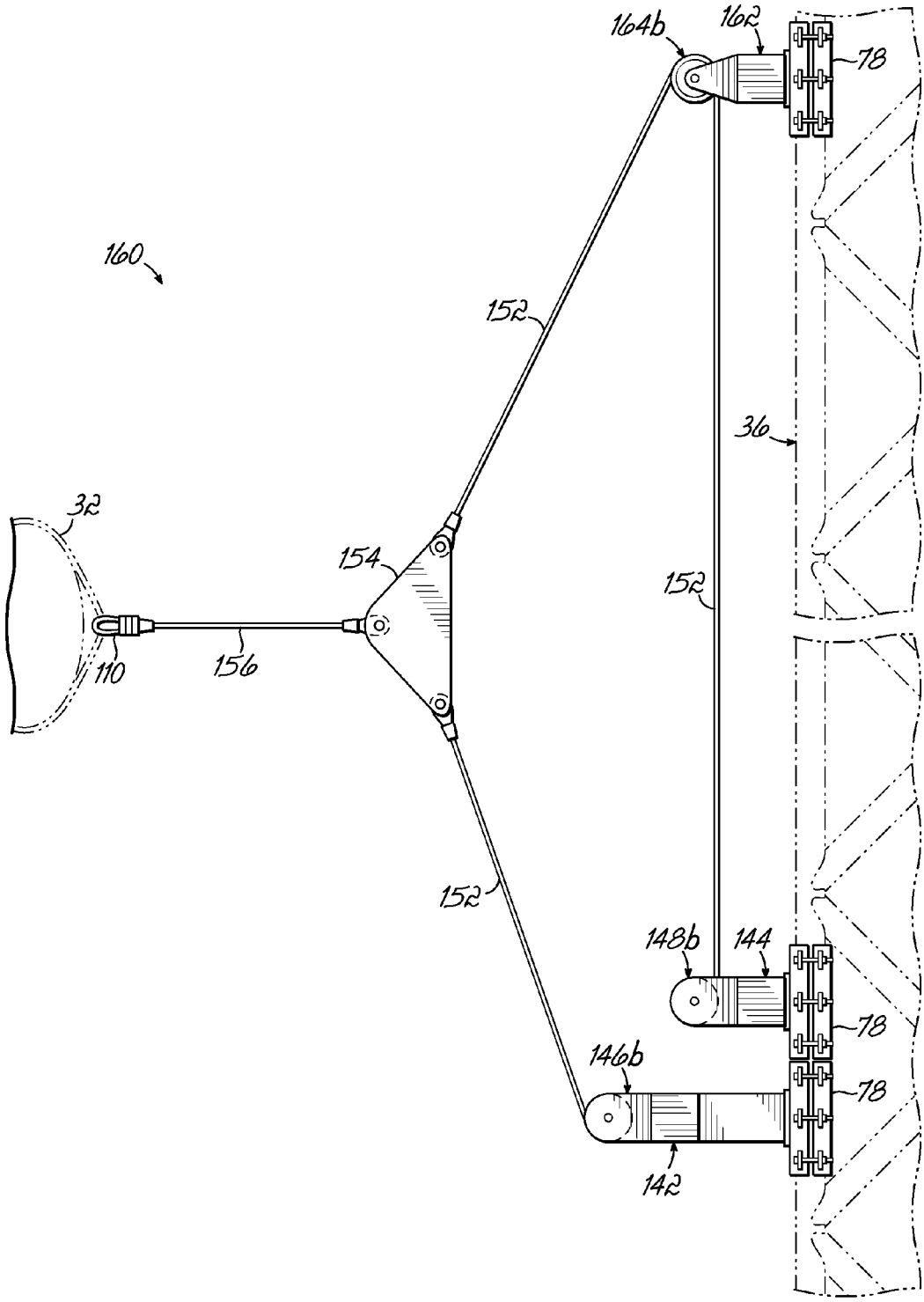
FIG. 6B is a side elevation view of a control mechanism in accordance with a fifth embodiment.
Figure 6C:
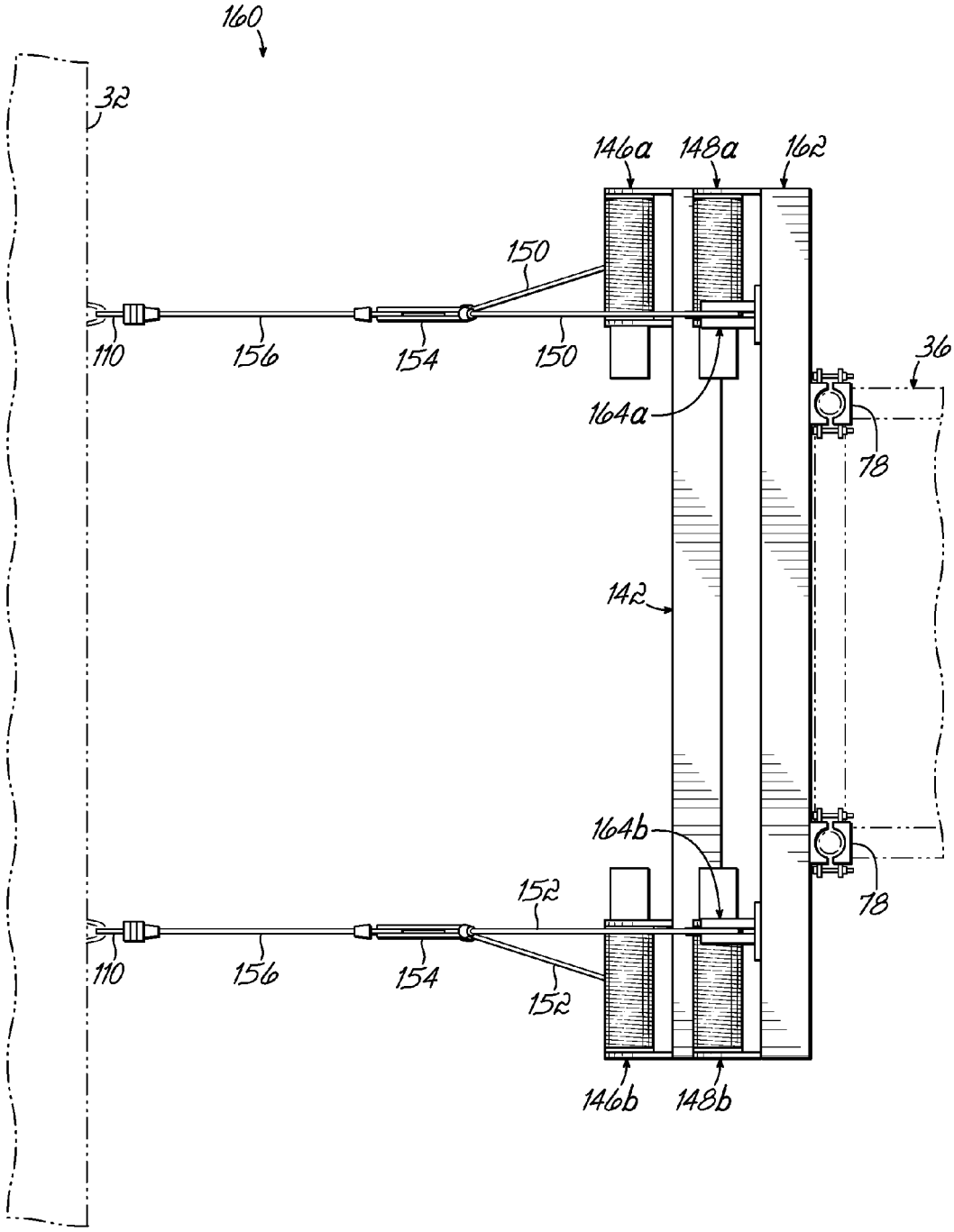
FIG. 6C is a top view of the control mechanism shown in FIG. 6B.

As shown in FIGS. 6A-6C, in which like reference numerals refer to like features in FIGS. 5A-5C, crane 30 may include a control mechanism 160 configured to control, for example, the orientation of load 32 relative to the central axis 72 in an improved manner. Control mechanism 160 may include a first support member 142 coupled to the main boom 36 adjacent its first, lower end. In one embodiment, as illustrated in FIG. 6A, winches 146*a*, 146*b*, 148*a*, 148*b* may all be coupled to the first support member 142. In an alternative embodiment, however, and as illustrated in FIGS. 6B and 6C, control mechanism 160 may include a second support member 144 also coupled to main boom 36 adjacent its first, lower end. The first support member 142 in this latter embodiment may include winches 146*a*, 146*b* while the second support member 144 may include winches 148*a*, 148*b*.

Regardless of how the winches 146*a*, 146*b*, 148*a*, 148*b* are mounted, a third support member 162 may be coupled to the main boom 36 adjacent its second, upper end and include a pair of sheaves 164*a*, 164*b* coupled thereto in spaced relation. Although not limited to such a configuration, sheave 164*a* may be arranged so as to generally align with the winches 146*a*, 148*a* and sheave 164*b* may be arranged so as to generally align with winches 146*b*, 148*b* (e.g., substantially parallel to the longitudinal axis of the main boom 36).

The guide cable 150 is trained over sheave 164*a* with one end operatively coupled to winch 146*a* and the other end operatively coupled to winch 148*a*. Winches 146*a*, 148*a* are independently controllable and capable of reeling in and paying out guide cable 150 in a controllable manner. In a similar manner, guide cable 152 is trained over sheave 164*b* with one end operatively coupled to winch 146*b* and the other end operatively coupled to winch 148*b*. Winches 146*b*, 148*b* are also independently controllable (and independently controllable relative to winches 146*a*, 148*a*) and capable of reeling in and paying out guide cable 152 in a controllable manner.

Operation of these embodiments is similar to that described previously for FIGS. 5A-5C. Thus, for sake of brevity, a detailed explanation of the operation of these embodiments will be omitted. Those of ordinary skill in the art will readily recognize how to operate control mechanism 160 based on the explanation above in regard to control mechanism 140 shown and described in FIGS. 5A-5C. Additionally, the embodiments shown in FIGS. 6A-6C may have benefits similar to those described above for the previous embodiments.

The previous embodiments were actively driven systems where the movable member is capable of being independently driven along main boom 36. However, in alternative designs, the movable member may not include such a drive mechanism, but instead may move along main boom 36 in a passive manner. For example, the movable member may be moved along main boom 36 as a consequence of the coupling member being coupled to the load 32, and load 32 being raised by the main bearing cable 48. In other words, in such passive systems, the movable member is essentially dragged up the guide members as the load 32 is being raised by main bearing cable 48. In this regard, such systems may be less complex and perhaps more desirable in some applications.

Figure 7A:
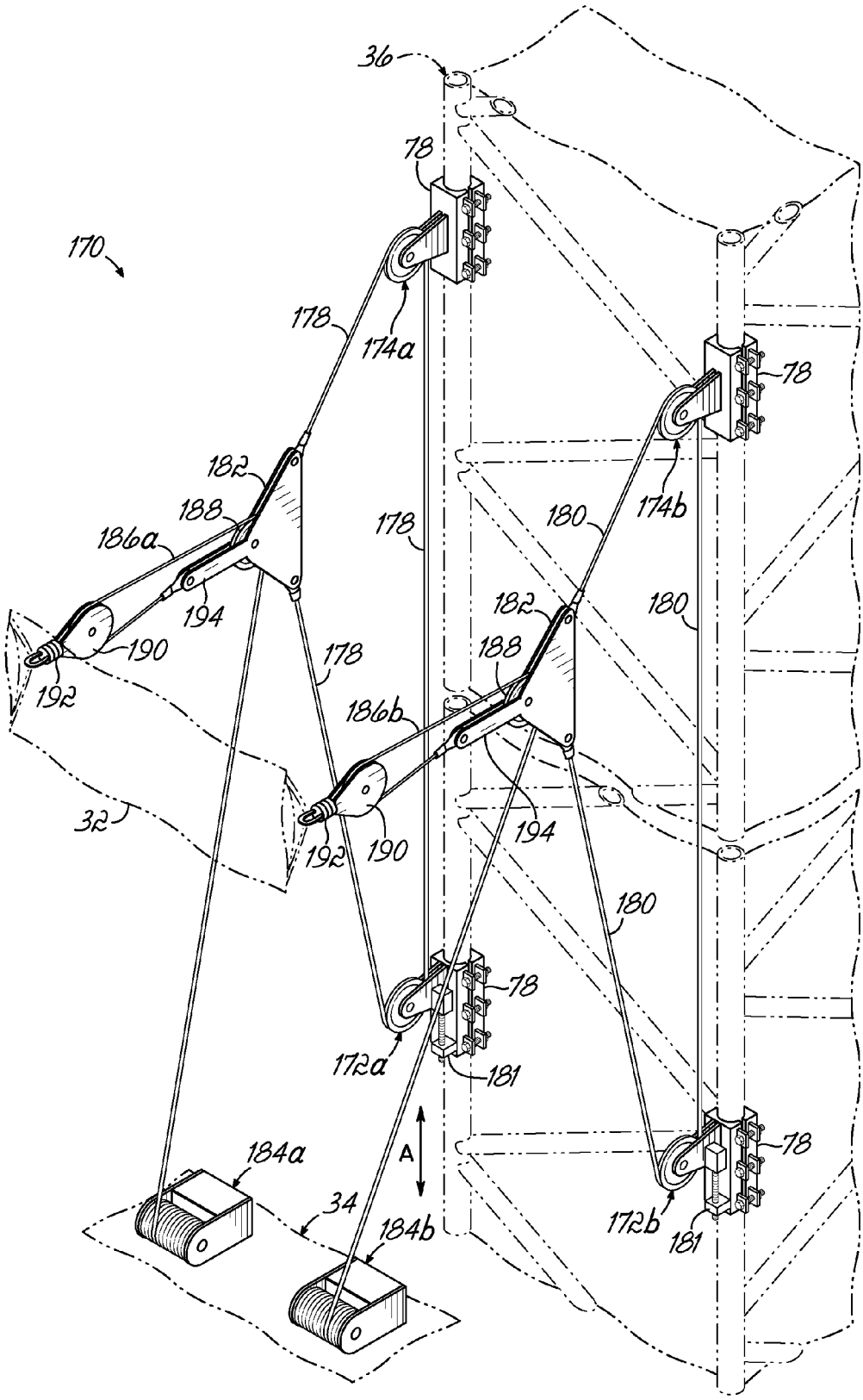
FIG. 7A is a perspective view of a control mechanism in accordance with a sixth embodiment.
Figure 7B:
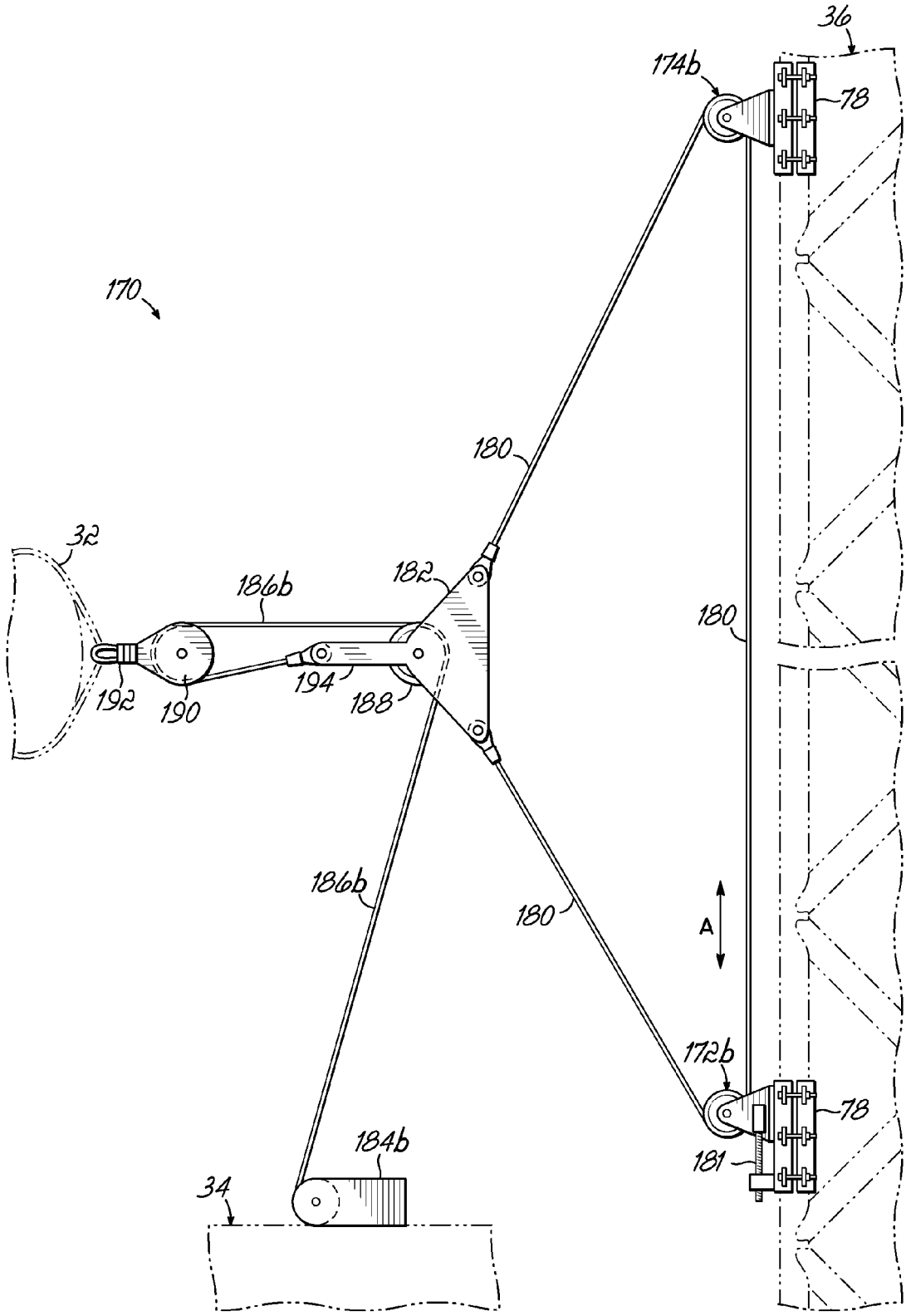
FIG. 7B is a side elevation view of the control mechanism shown in FIG. 7A.

FIGS. 7A-7B, in which like reference numerals refer to like features in FIGS. 1 and 2, illustrate such a passive system embodiment. In this embodiment, crane 30 includes a control mechanism 170 configured to control, for example, the orientation of the load 32 relative to the central axis 72 in an improved manner. Control mechanism 170 includes a guide member that includes a pair of guide cables 178, 180 extending along main boom 36. To this end, the control mechanism 170 includes first pair of sheaves 172*a*, 172*b* coupled to the main boom 36 adjacent its first, lower end, and a second pair of sheaves 174*a*, 174*b* coupled to the main boom 36 adjacent its second, upper end. For example, the sheaves 172*a*, 172*b*, 174*a*, 174*b* may be coupled to main boom 36 using conventional techniques such as clamps 78. The sheaves may additionally or alternatively be coupled to main boom 36 using other techniques including welding or using other suitable fasteners. The guide cables 178, 180 extend along the main boom 36 between the sheaves 172*a*, 174*a* and 172*b*, 174*b*, respectively. The guide cables 178, 180 are trained over their respective sheaves so as to form a closed loop configuration. One of the pairs of sheaves, such as, for example, sheaves 172*a*, 172*b* may each include an adjustment mechanism 181 for adjusting the tension in guide cables 178, 180.

The control mechanism 170 further includes a movable member that in one embodiment may include separate plate members 182 coupled to each of the guide cables 178, 180. In one embodiment, the plate members 182 may be directly spliced into cables 178, 180 such that end of cables 178, 180 couple to eyelets or apertures in plate member 182, such as at two corners thereof. In this way, the plate members 182 move along main boom 36 through movement of guide cables 178, 180. Those of ordinary skill in the art will recognize other arrangements for coupling plate members 182 to cables 178, 180, including welding, or other suitable fasteners. Those of ordinary skill in the art will further recognize that the plate members 182 are not limited to the configuration shown, but that other shapes and designs for plate members 182 are also possible.

The control mechanism 170 further includes a coupling member configured to include a pair of winches 184*a*, 184*b* and corresponding tag lines 186*a*, 186*b*, respectively, operatively coupled thereto. Unlike the embodiment shown in FIGS. 3A-3B, the winches 184*a*, 184*b* are not coupled to the movable member (e.g., plate members 182), but instead may be coupled to, for example, base 34 of crane 30 or the first end of main boom 36. Thus, tag line 186*a* has a first end operatively coupled to winch 184*a*, which is configured to reel in and pay out tag line 186*a* in a controllable manner, and is trained over a sheave 188 rotatably mounted to plate member 182. The tag line 186*a* is further trained over a sheave 190 rotatably mounted to a connecting member 192 configured to couple the tag line 186*a* to the load 32. For example, the connecting member 192 may include a hook for coupling to load 32. Those of ordinary skill in the art will recognize, however, that other connecting members may also be used. A second end of the tag line 186*a* is coupled to plate member 182 in a manner that does not prohibit rotation of sheave 188. For example, an arm 194 may extend from plate member 182, an end of which may be configured to receive the end of tag line 186*a*. Such an arrangement having tag line 186*a* looping around sheave 190, operatively couples tag line 186*a* to connecting member 192. The winch 184*b* and tag line 186*b* may have a similar configuration, as illustrated in FIGS. 7A and 7B.

In operation, the main bearing cable 48 may be paid out to locate the jib block 50 adjacent the ground or support surface so as to couple the jib block 50 to the load 32. In this initial position of main bearing cable 48, the plate members 182 of guide cables 178, 180 may be positioned adjacent the first, lower end of main boom 36. The motorized winches 184*a*, 184*b* may be activated to pay out tag lines 186*a*, 186*b* so that connecting member 192 may be coupled to the load 32. As the load 32 is initially lifted off the ground, the winches 184*a*, 184*b* may be activated to impose a suitable tension in tag lines 186*a*, 186*b*. Adjustment mechanisms 181 may also be used to adjust the tension in guide cables 178, 180.

The main winch 54 may be activated to reel in the main bearing cable 48 and raise the load 32 upwardly into the atmosphere 20. As noted above, this embodiment uses a passive drive system to move the plate member 182 along main boom 36. In this regard, as the load 32 is being raised by main bearing cable 48, the plate members 182 are also pulled upwardly due to the tag lines 186*a*, 186*b* that extend between the plate members 182 and the connecting members 192, which are coupled to load 32. Because the movement of main bearing line 48 in essence drives the motion of plate members 182, the plate members 182 may slightly lag behind the load 32, depending on the tension on the tag lines 186*a*, 186*b*. Thus, in one embodiment, the plate members 182 and load 32 may be nearly within the same horizontal plane (e.g., both have almost the same height relative to the ground or support surface). Any difference in the height of the load 32 and plate members 182 may be held relatively low with proper operation of winches 184*a*, 184*b* during the lift.

In this regard, it should be realized that winches 184*a*, 184*b* may be activated to maintain the tension in the tag lines 186*a*, 186*b* as the load 32 is being raised. Maintaining the tension in tag lines 186*a*, 186*b* stabilizes the load 32 during the lift, maintains the orientation of the load 32 relative to central axis 72 (e.g., the tag lines 186*a*, 186*b* prevent the load 32 from rotating about central axis 72), and maintains movement of the load 32 in a generally vertical direction along central axis 72. Those of ordinary skill in the art will recognize how to activate winches 184*a*, 184*b* to maintain the tension in tag lines 186*a*, 186*b* and provide the desired movement of load 32 during the lift.

When the load 32 is raised to a sufficient height, such as adjacent the top of tower 12 (FIG. 1), it may be desirable to vary the orientation of the load 32 to facilitate assembly of the component to the wind turbine 10. To this end, the winches 184*a*, 184*b* may be activated to vary the orientation of the load 32. More particularly, to rotate the load 32 about central axis 72 in a first direction (e.g., clockwise direction), one of the winches 184*a*, 184*b* may be activated so as to pay out, and thereby lengthen, one of tag lines 186*a*, 186*b*, while the other of winches 184*a*, 184*b* may be activated so as to reel in, and thereby shorten, the other of tag lines 186*a*, 186*b*. To rotate the load 32 about the central axis 72 in a second direction (e.g., counterclockwise), the winches 184*a*, 184*b* may be operated in the opposite manner. Once the proper orientation of the load 32 has been achieved, assembly workers on the tower 12 may secure the component to the wind turbine 10 and uncouple the tag lines 186*a*, 186*b* and main bearing cable 48 from the load 32. The crane 30 may then be used to raise another component for further assembly of wind turbine 10.

Although control mechanism 170 has a has a slightly different design and operation as compared to the various control mechanisms described above, it is believed that control mechanism 170 also addresses many of the drawbacks of existing apparatus and techniques and provides many of the same benefits as those provided by the previous control mechanisms that have been described above.

Figure 8A:
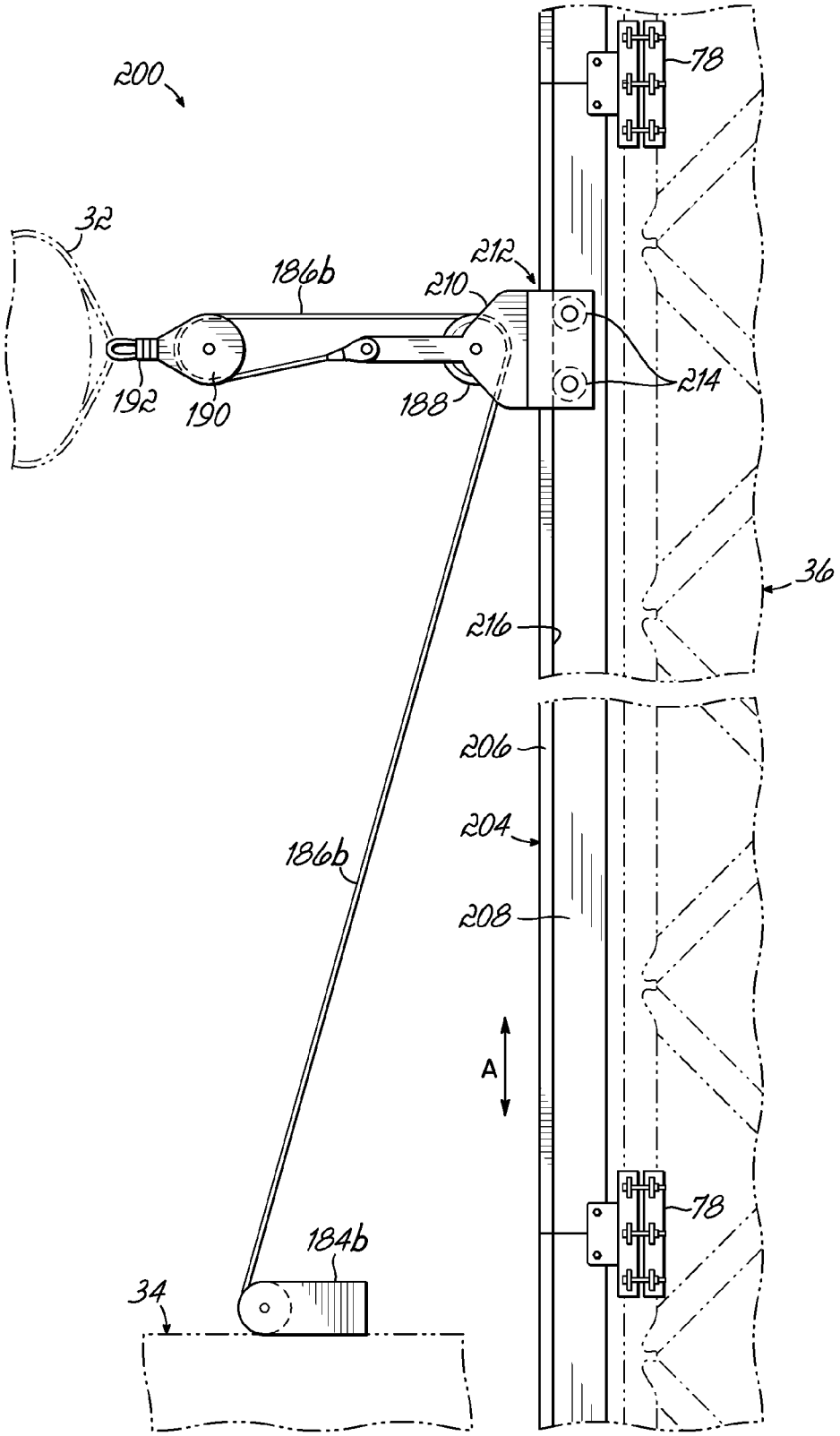
FIG. 8A is a side elevation view of a control mechanism in accordance with a seventh embodiment.
Figure 8B:
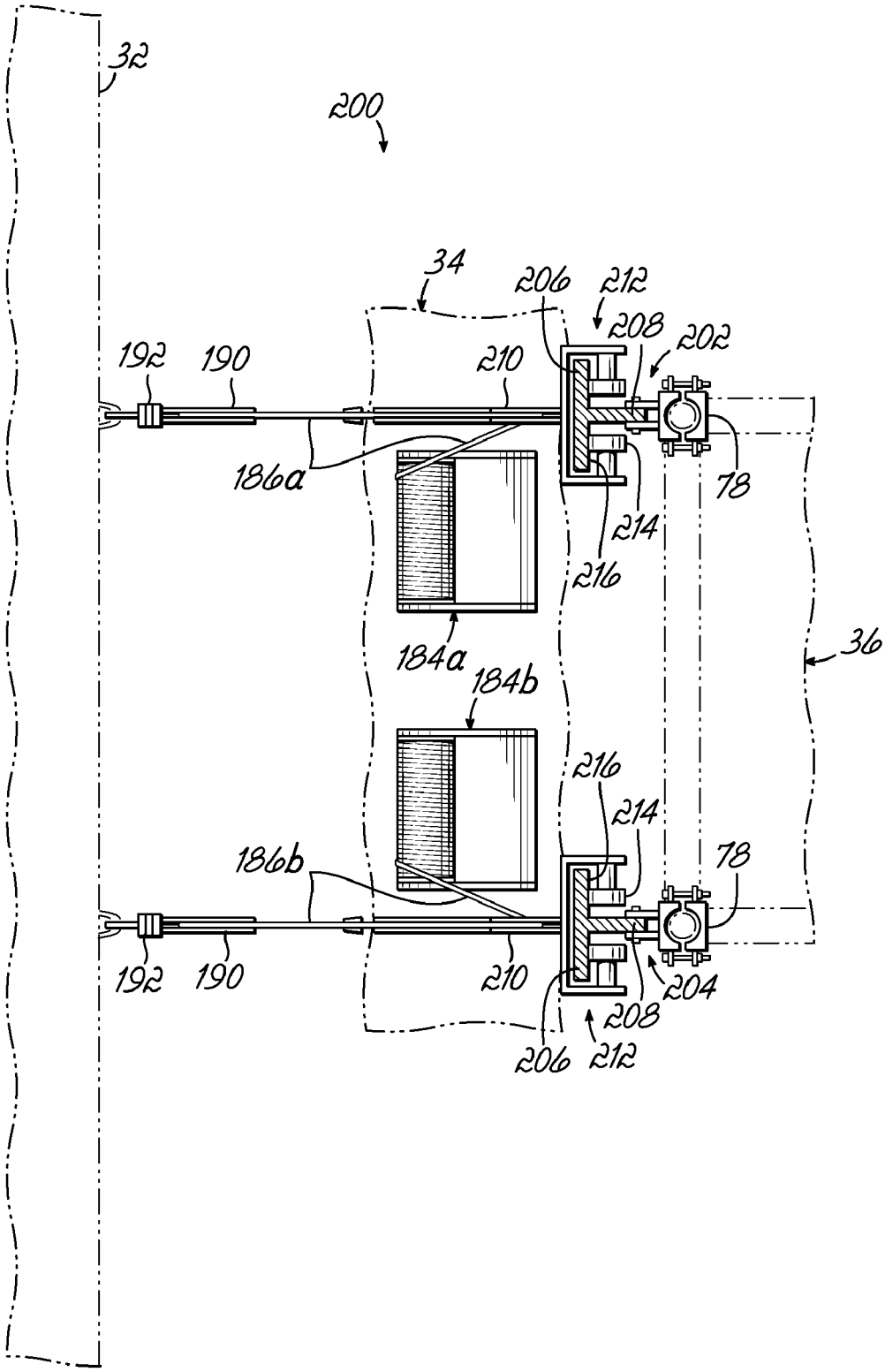
FIG. 8B is a top view of the control mechanism shown in FIG. 8A.
Figure 8C:
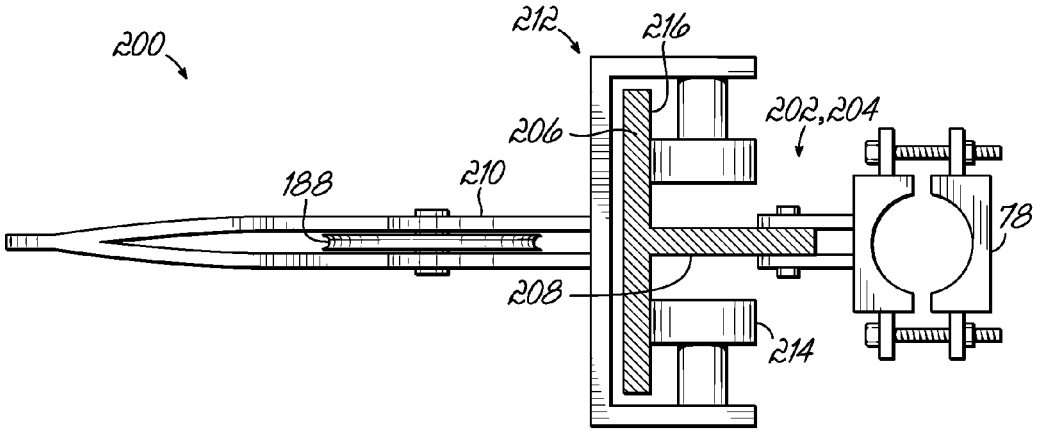
FIG. 8C is a top view of a portion of the control mechanism shown in FIG. 8A.

Yet another embodiment of an exemplary control system is shown in FIGS. 8A-8C and is similar to the embodiment shown in FIGS. 7A and 7B. Thus, like reference numerals are used to refer to like features in these figures. FIGS. 8A and 8B illustrate a control mechanism 200 having guide members in the form of guide rails 202, 204 extending along main boom 36 and coupled thereto utilizing conventional techniques including welding, fasteners, such as clamps 78, or other suitable connecting elements. In one embodiment, and as illustrated in FIG. 8C, the guide rails 202, 204 may each include an elongate beam having a T-shaped cross section and defining an outer flange 206 and a rib 208 extending from a central portion of the flange 206.

Control mechanism 200 further includes a movable member movably coupled to the guide member. In this embodiment, the movable member may include a plate member 210 movably mounted to each of the guide rails 202, 204. Plate members 210 may be similar to plate members 182 discussed in the previous embodiment. However, the plate members 210 are not spliced within the guide members, as were plate members 182. Instead, and as illustrated in FIG. 8A, each plate member 210 may include a roller assembly 212 having at least one roller 214 to facilitate movement of the plate member 210 along rails 202, 204. Roller assembly 212 may be similar to roller assembly 130 discussed above and shown in FIG. 4. Accordingly, a detailed description of the roller assembly 212 will be omitted. When the plate member 210 is mounted to the rails 202, 204, rollers 214 may be configured to engage and roll along an interior surface 216 of flange 206. Although not shown, it should be realized that roller assembly 212 may also include rollers 214 to engage and roll along an exterior surface of flange 206.

The coupling member and other remaining structural features are similar to those described above in reference to FIGS. 7A and 7B. Thus, a detailed description of these features will also be omitted. Moreover, operation of this embodiment is similar to that described previously for FIGS. 7A and 7B. Thus, for sake of brevity, a detailed explanation of its operation will not be provided herein. The primary difference is that the guide members are T-shaped rails instead of guide cables, and roller assemblies are used to movably couple the plate members to the guide members. In any event, those of ordinary skill in the art will readily recognize how to operate control mechanism 200 based on the explanation above in regard to FIGS. 7A and 7B. Additionally, the embodiment shown in FIGS. 8A-8C may have benefits similar to those described above for the previous embodiments.

Figure 9A:
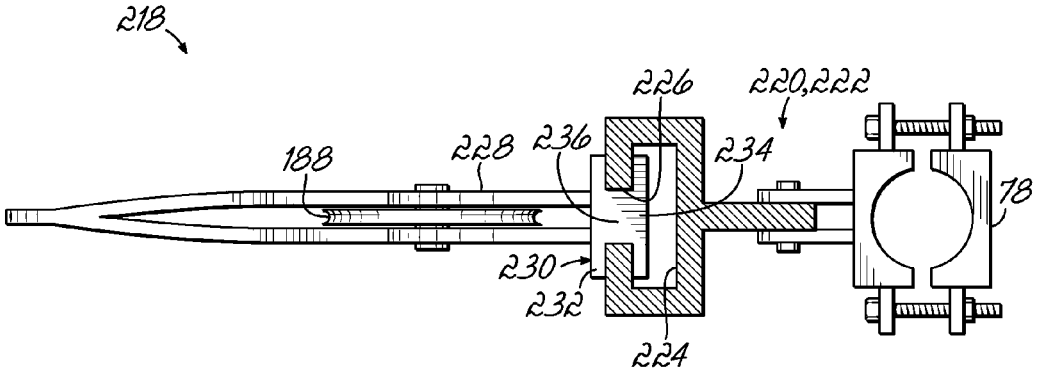
FIG. 9A is a top view similar to FIG. 8C illustrating a control mechanism in accordance with an eighth embodiment.
Figure 9B:
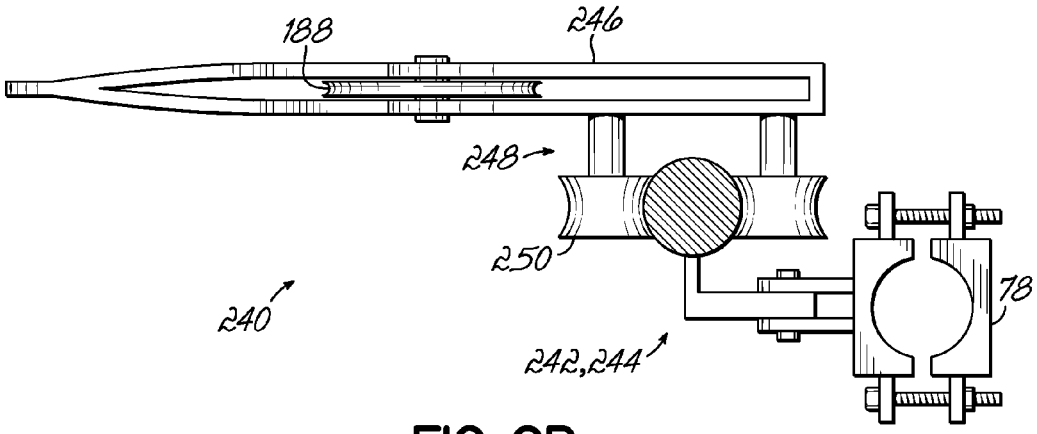
FIG. 9B is a top view similar to FIG. 8C illustrating a control mechanism in accordance with a ninth embodiment.

As shown in FIG. 8C, in one embodiment, the rails 202, 204 may have a T-shaped cross-sectional shape and the plate members 210 may couple to rails 202, 204 via rollers 214. However, the rails 202, 204 may have other configurations. For example, such alternative configurations are shown in FIGS. 9A and 9B. As illustrated in FIG. 9A, a control mechanism 218 may have guide members that include guide rails 220, 222 extending along main boom 36 and coupled thereto utilizing conventional techniques. In this embodiment, the guide rails 220, 222 may each include an elongate beam having an inverted C-shaped cross section that defines an interior cavity 224 and an opening 226 in communication with the interior cavity 224.

The control mechanism 218 may further include a movable member in the form of plate members 228 movably mounted to each of the guide rails 220, 222. Plate members 228 may be similar to plate members 210 discussed in the previous embodiment. However, the plate members 228 may be coupled to guide rails 220, 222 in a different manner. In this regard, and as illustrated in FIG. 9A, each plate member 228 may include a slider 230 to facilitate movement of the plate members 228 along rails 220, 222. Slider 230 may have an I-shaped cross section defining two opposed flanges 232, 234 and an intermediate web 236. When the plate members 228 are mounted to the rails 202, 204, flange 234 is positioned inside internal cavity 224, flange 232 is external to the rails 220, 222, and intermediate web 236 is positioned within opening 226. In this way, the sliders 230 cannot be pulled away from the rails 220, 222, but allows sliding motion of plate members 228 therealong. Operation of control mechanism 218 is similar to that described above and a detailed explanation will be omitted. Those of ordinary skill in the art will recognize how to operate control mechanism 218 based on the description of the operation of previous embodiments.

In yet another embodiment as illustrated in FIG. 9B, a control mechanism 240 may have guide members that include guide rails 242, 244 extending along main boom 36 and coupled thereto utilizing conventional techniques. In this embodiment, the guide rails 242, 244 may each include an elongate beam having a circular cross section. The control mechanism 240 may further include a movable member that includes a plate member 246 movably mounted to each of the guide rails 242, 244. Plate members 246 may be similar to plate members 228 discussed in the previous embodiment. However, the plate members 246 may be coupled to guide rails 242, 244 in a different manner. In this regard, and as illustrated in FIG. 9B, each plate member 246 may include a roller assembly 248 having at least one roller 250 to facilitate movement of the plate members 246 along rails 242, 244. The rollers 250 may have an engaging surface shaped to match the circular contour of the rails 242, 244. When the plate members 246 are mounted to the rails 242, 244, one roller is positioned on a first side of rails 242, 244 and a second roller is positioned on a second side of rails 242, 244 opposite the first side. In this way, the roller assembly 248 cannot be pulled away from the rails 242, 244, but allows rolling motion of plate members 248 therealong. Operation of control mechanism 240 is similar to that described above and a detailed explanation will be omitted. Those of ordinary skill in the art will recognize how to operate control mechanism 240 based on the description of the operation of previous embodiments.

Figure 7C:
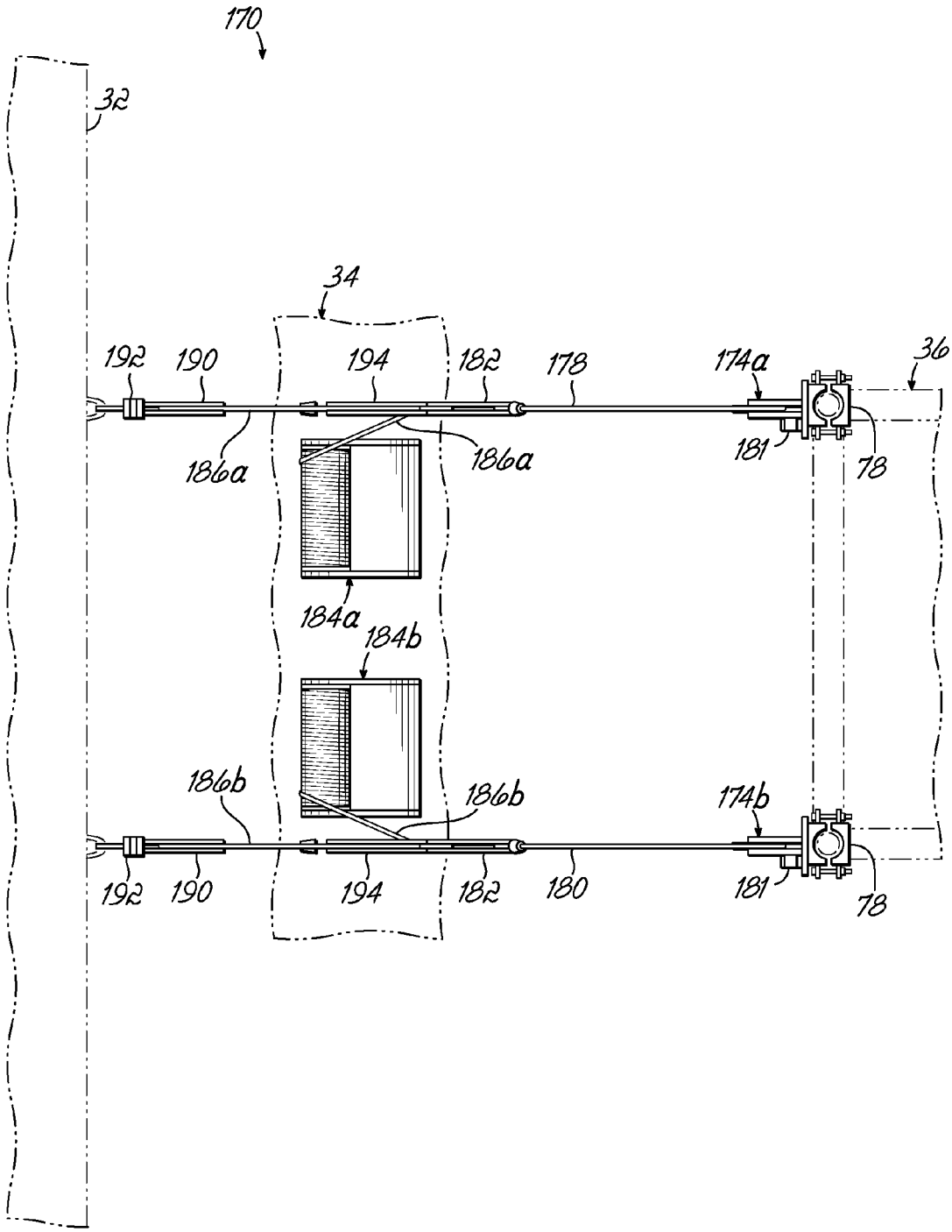
FIG. 7C is a top view of the control mechanism shown in FIG. 7A.
Figure 10:
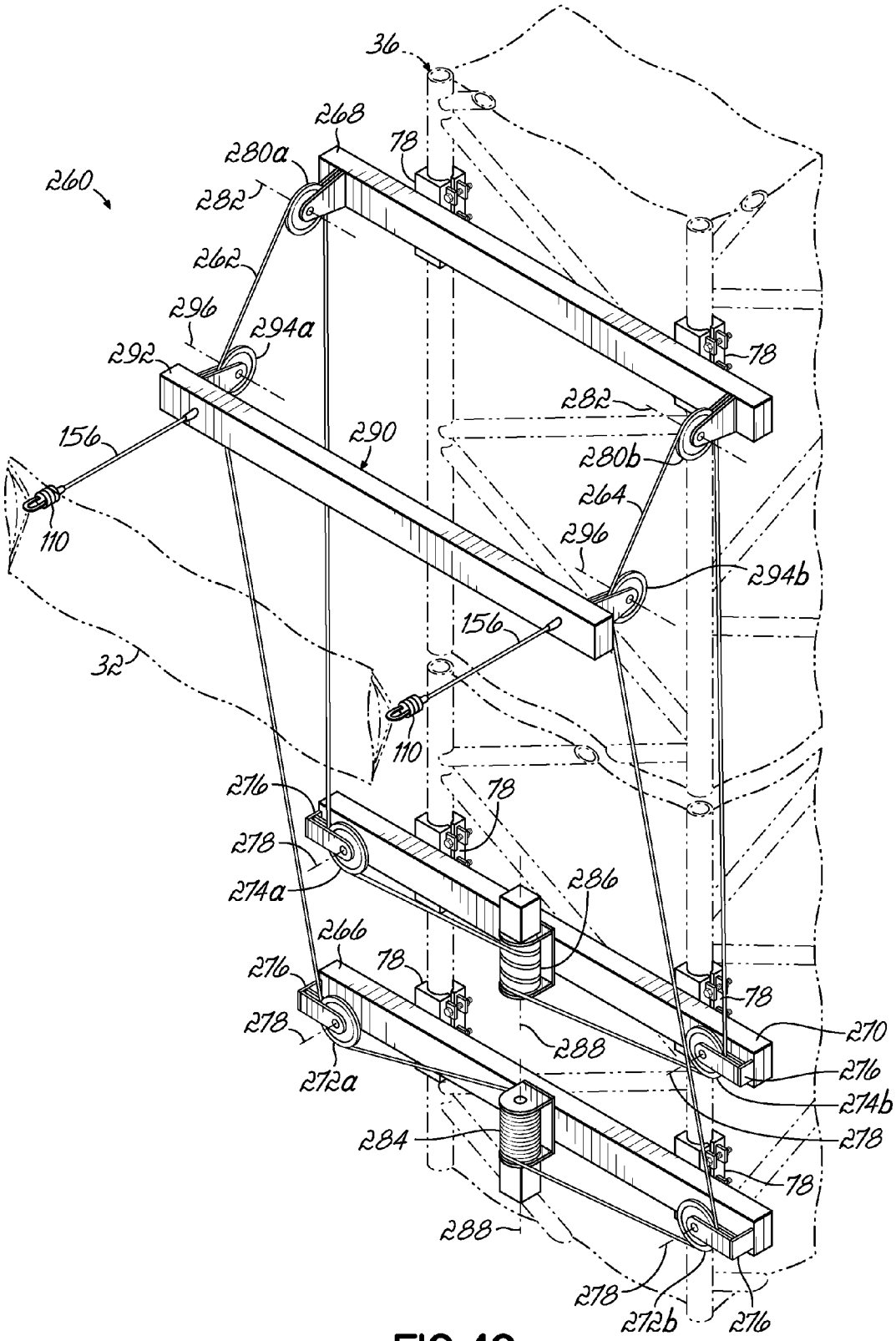
FIG. 10 is a perspective view of a control mechanism in accordance with a tenth embodiment.

FIG. 10, in which like reference numerals refer to like features in FIGS. 7A-7C, illustrates another passive system embodiment. In this embodiment, crane 30 includes a control mechanism 260 configured to control, for example, the orientation of the load 32 relative to the central axis 72 of main bearing cable 48 in an improved manner. Control mechanism 260 includes a guide member that includes a pair of guide cables 262, 264 extending along main boom 36. As explained in more detail below, in this embodiment, the guide member may be formed from a single cable with guide cables 262, 264 being separate portions or branches thereof. The control mechanism 260 includes a first support member 266 coupled to the main boom 36 adjacent its first, lower end, and a second support member 268 coupled to the main boom 36 adjacent its second, upper end. In one embodiment, a third support member 270 may be coupled to the main boom 36 adjacent the first support member 266. In an alternative embodiment (not shown), the first and third support members 266, 270 may be combined into a single support member. In one embodiment, these support members 266, 268, 270 may extend in a direction generally perpendicular to the longitudinal axis of the main boom 36 and be coupled to main boom 36 using clamps 78, for example. The support members 266, 268, 270 may additionally or alternatively be coupled to main boom 36 using other techniques including welding or using other suitable fasteners.

The first and third support members 266, 270 each include a pair of sheaves 272*a*, 272*b*, 274*a*, 274*b*, respectively, coupled thereto, such as adjacent opposed ends thereof. Each of the sheaves 272*a*, 272*b*, 274*a*, 274*b* are coupled to their respective support members using L-shaped brackets 276 so as to orient a rotational axis 278 of the sheaves generally perpendicular to a longitudinal axis of the support members 266, 270. Support member 268 also includes a pair of sheaves 280*a*, 280*b* coupled thereto such as adjacent opposed ends thereof. In contrast to sheaves 272*a*, 272*b*, 274*a*, 274*b*, the sheaves 280*a*, 280*b* are oriented such that their rotational axis 282 is generally parallel to the longitudinal axis of the second support member 268.

Each of the first and third support members 266, 270 may also include at least one winch 284, 286 (one shown in FIG. 10) coupled thereto so as to be, for example, disposed between the pair of sheaves 272*a*, 272*b*, 274*a*, 274*b*. The winches 284, 286 may be oriented such that the rotational axes 288 thereof are generally perpendicular to the longitudinal axis of their respective support members. The guide cables 262, 264 generally extend along main boom 36 between the first and third support members 266, 270 adjacent the lower end thereof and the second support member 268 adjacent the upper end thereof. As noted above, the guide cables 262, 264 are formed by one single cable having both ends operatively coupled to winch 284 and having branch 262 trained about sheaves 272*a*, 280*a*, and 274*a* and branch 264 trained about sheaves 272*b*, 280*b*, and 274*b*. An intermediate portion of the single cable is wrapped about winch 286, which effectively defines a division between the two branches. The cable is operatively coupled to the winch 284 such that when winch 284 is activated, both guide cables 262, 264 are reeled in or paid out together (e.g., respond in a similar manner). The single cable is also operatively coupled to the winch 286 such that when winch 286 is activated, guide cable 262 is reeled in or paid out and guide cable 264 is paid out or reeled in, respectively (e.g., respond in an opposite manner).

Control mechanism 260 further includes a movable member that in one embodiment includes a carriage 290 operatively coupled to the guide cables 262, 264. In this regard, the carriage 290 includes a main support member 292 that extends in a direction generally perpendicular to the longitudinal axis of the main boom 36. Support member 292 also includes a pair of sheaves 294*a*, 294*b* coupled thereto such as adjacent opposed ends thereof that are oriented such that their rotational axis 296 is generally parallel to the longitudinal axis of the main support member 292. Each of guide cables 262, 264 is trained about sheaves 294*a*, 294*b* such that the carriage 290 is disposed between the first and third support members 266, 270.

The control mechanism 260 further includes a coupling member having a fixed length cable 156 with one end coupled to the main support member 292 of carriage 290, and the other end configured to be coupled to load 32. In this regard, this end of fixed cable 156 may include a suitable connecting member 110, such as, for example, a hook, to couple the fixed cable 156 to load 32 (such as to a frame, sling, or other holding member that supports the wind turbine component during the lift). Other connecting members, however, are also possible.

In operation, the main bearing cable 48 may be paid out to locate the jib block 50 adjacent the ground or support surface so as to couple the jib block 50 to the load 32. In this initial position of main bearing cable 48, the carriage 290 may be positioned adjacent the first, lower end of main boom 36. Winch 284, which controls the tension in guide cables 262, 264, may be activated to pay out guide cables 262, 264 so that the hook or other connecting member 110 on fixed cable 156 may be coupled to the load 32. Once coupled to the load 32, winch 284 may be activated to tension the guide cables 262, 264 to a desired level.

The main winch 54 may be activated to reel in the main bearing cable 48 and raise load 32 upwardly and into the atmosphere 20. As noted above, this embodiment uses a passive drive system to move the carriage 290 along the main boom 36. In this regard, as the load 32 is being raised by main bearing cable 48, the carriage 290 is also pulled upwardly due to the fixed cable 156 that extends between the carriage 290 and the load 32. Because the movement of main bearing cable 48 in essence drives the motion of carriage 290, the carriage 290 may slightly lag behind the load 32, depending on the tension of guide cables 262, 264. Thus in one embodiment, the carriage 290 and load 32 may be nearly within the same horizontal plane (e.g., both have almost the same height relative to the ground or support surface). Any difference in the height of the load 32 and carriage 290 may be held low with proper operation of winch 284 during the lift.

When the load is raised to a sufficient height, such as adjacent the top of tower 12 (FIG. 1), it may be desirable to vary the orientation of the load 32 to facilitate assembly of the component to the wind turbine 10. To this end, winch 286 may be activated to vary the orientation of the load 32. More particularly, when winch 286 is activated in a first direction (e.g., clockwise direction) one of the guide cables 262, 264 is shortened while the other of guide cables 262, 264 is lengthened. To rotate the load 32 in a second direction (e.g., counter clockwise direction), the winch 286 may be operated in the opposite manner. Once the proper orientation of the load 32 has been achieved, assembly workers on the tower 12 may secure the component to the wind turbine 10 and uncouple the fixed cable 156 and main bearing cable 48 from the load 32. The crane 30 may then be used to raise another component for further assembly of wind turbine 10.

While the present invention has been illustrated by a description of various preferred embodiments and while these embodiments have been described in some detail, it is not the intention of the inventor to restrict or in any way limit the scope of the appended claims to such detail. Additional advantages and modifications will readily appear to those skilled in the art. For example, some of the passive drive systems described herein may be readily modified to include suitable drive mechanisms. Moreover, some of the active drive systems include elements which may be used in passive drive systems. Thus, the various features of the invention may be used alone or in any combination depending on the needs and preferences of the user.

What is claimed is:

1. An apparatus for assembling a wind turbine, comprising:

a crane boom having a main bearing cable configured to be coupled to a component of a wind turbine for lifting the component during assembly of the wind turbine and defining a main bearing axis; and a control mechanism operatively coupled to the crane boom for controlling the rotation of the wind turbine component about the main bearing axis, the control mechanism comprising:

a guide member coupled to the crane boom;

a movable member coupled to the guide member and configured to be movable relative to the crane boom in a direction guided by the guide member;

a coupling member configured to couple the movable member to the wind turbine component at an angle generally transverse to and at a location spaced from the main bearing axis; and a drive mechanism configured to actively raise and lower the movable member relative to the crane boom independent of the movement of the main bearing cable.

2. The apparatus of claim 1, wherein the guide member includes a guide rail.

3. The apparatus of the claim 1, wherein the movable member includes a carriage movably mounted on the guide member.

4. The apparatus of claim 1, wherein the coupling member comprises:

a winch coupled to the movable member; and a tag line having one portion operatively coupled to the winch and another portion configured to be operatively coupled to the wind turbine component, wherein the winch is configured to reel in and pay out the tag line.

5. The apparatus of claim 1, wherein the drive mechanism includes a rack and gear operatively coupled to the movable member and configured to raise and lower the movable member relative to the crane boom.

6. The apparatus of claim 1, wherein the drive mechanism includes a winch arrangement operatively coupled to the movable member and configured to raise and lower the movable member relative to the crane boom.

7. The apparatus of claim 1, wherein the guide member includes a guide cable.

8. The apparatus of claim 1, wherein the movable member includes a plate member spliced into the guide member such that movement of the movable member is achieved by movement of the guide member.

9. The apparatus of claim 1, wherein the control mechanism further comprises:

a first support member coupled to the crane boom and having a winch operatively coupled thereto; and a second support member coupled to the crane boom spaced from the first support member and also having a winch operatively coupled thereto, wherein the guide member includes a guide cable operatively coupled to a winch on each of the first and second support members.

10. The apparatus of claim 1, wherein the control mechanism further comprises:

a first support member coupled to the crane boom and having at least one winch operatively coupled thereto;

a second support member coupled to the crane boom spaced from the first support member and having a sheave operatively coupled thereto, wherein the guide member includes a guide cable operatively coupled to a winch on the first support member and received by the sheave on the second support member.

11. The apparatus of claim 10, further comprising a third support member coupled to the crane boom adjacent the first support member having at least one winch operatively coupled thereto, wherein the guide cable is operatively coupled to the winch on the third support member.

12. The apparatus of claim 1, wherein the coupling member includes a first coupling member and a second coupling member, the first coupling member being configured to couple the movable member to the wind turbine component at a first location and the second coupling member being configured to couple the movable member to the wind turbine component along the longitudinal axis of the component at a second location opposite the main bearing axis from the first location.

13. An apparatus for assembling a wind turbine, comprising:

a crane boom having a main bearing cable configured to be coupled to a component of a wind turbine for lifting the component during assembly of the wind turbine; and a control mechanism operatively coupled to the crane boom for controlling the orientation of the wind turbine component, the control mechanism comprising:

a guide member coupled to the crane boom;

a movable member coupled to the guide member and configured to be movable relative to the crane boom in a direction guided by the guide member;

a coupling member configured to couple the movable member to the wind turbine component;

an actuator configured to move the coupling member relative to the movable member in a direction substantially perpendicular to a longitudinal axis of the crane boom; and a drive mechanism configured to actively move the movable member relative to the crane boom independent of the movement of the main bearing cable.

14. An apparatus for assembling a wind turbine, comprising:

a crane boom having a main bearing cable configured to be coupled to a component of a wind turbine for lifting the component during assembly of the wind turbine and defining a main bearing axis; and a control mechanism operatively coupled to the crane boom for controlling the rotation of the wind turbine component about the main bearing axis, the control mechanism comprising:

a guide member coupled to the crane boom, wherein the guide member includes a guide cable;

a movable member coupled to the guide cable and configured to be raised and lowered with the guide cable relative to the crane boom in a direction guided by the guide member; and a coupling member configured to couple the movable member to the wind turbine component at an angle generally transverse to and at a location spaced from the main bearing axis, wherein the coupling member includes a winch spaced from the movable member and a tag line having one end portion operatively coupled to the winch, another end portion configured to be operatively coupled to the wind turbine component, and an intermediate portion received by the movable member.

15. The apparatus of claim 14, wherein the movable member includes a plate member.

16. The apparatus of claim 15, wherein the guide member further includes a first sheave coupled to the crane boom, a second sheave coupled to the crane boom spaced from the first sheave, and the guide cable extends between the first and second sheaves in a closed loop configuration.

17. The apparatus of claim 16, wherein the plate member is spliced into the guide cable.

18. An apparatus for assembling a wind turbine, comprising:

a crane boom having a main bearing cable configured to be coupled to a component of a wind turbine for lifting the component during assembly of the wind turbine and defining a main bearing axis; and a control mechanism operatively coupled to the crane boom for controlling the rotation of the wind turbine component about the main bearing axis, the control mechanism comprising:

a guide member coupled to the crane boom including a guide cable operatively coupled to a first winch configured to vary the tension in the guide cable and operatively coupled to a second winch that defines a first and second portion of the guide cable, the second winch configured to vary the lengths of the first and second portions;

a movable member coupled to the guide member and configured to be raised and lowered relative to the crane boom in a direction guided by the guide member; and a coupling member configured to couple the movable member to the wind turbine component at an angle generally transverse to and at a location spaced from the main bearing axis.

19. The apparatus of claim 18, wherein the control mechanism further comprises:

a first support member coupled to the crane boom and having the first winch operatively coupled thereto, the first support member further having a pair of sheaves coupled thereto;

a second support member coupled to the crane boom spaced from the first support member and having a pair of sheaves operatively coupled thereto.

20. The apparatus of claim 19, further comprising a third support member coupled to the crane boom adjacent the first support member and having the second winch operatively coupled thereto, the third support member further having a pair of sheaves coupled thereto.

21. The apparatus of claim 18, wherein the movable member includes a carriage movably mounted on the guide member and movable relative to the guide member.

22. A method for assembling a wind turbine using a crane boom having a main bearing cable coupled to a wind turbine component and defining a main bearing axis during lifting of the wind turbine component, a movable member coupled to the crane boom and configured to be moved relative thereto, and a coupling member coupled to the movable member, comprising:

attaching the coupling member to the wind turbine component at an angle that is generally transverse to and at a location spaced from the main bearing axis;

lifting the wind turbine component with the main bearing cable;

activating a drive mechanism to raise or lower the movable member relative to the crane boom; and changing the orientation of the wind turbine component by rotating the wind turbine component about the main bearing axis using the coupling member.

23. The method of claim 22, wherein activating the drive mechanism includes using a rack and driven gear arrangement to move the movable member relative to the crane boom.

24. The method of claim 22, wherein activating the drive mechanism includes using a winch arrangement to move the movable member relative to the crane boom.

25. The method of claim 22, wherein changing the orientation of the wind turbine component using the coupling member includes activating a first winch to increase the length of a first tag line and activating a second winch to decrease the length of a second tag line.

26. The method of claim 22, wherein changing the orientation of the wind turbine component using the coupling member includes activating a first winch to increase the length of a first guide cable and activating a second winch to decrease the length of a second guide cable.

27. The method of claim 22, wherein the coupling member includes a first tag line and a second tag line, the method further comprising varying the distance between the tag lines in a direction substantially perpendicular to a longitudinal axis of the crane boom.

28. The method of claim 22, further comprising:

moving the movable member relative to the crane boom so as to be substantially within the same horizontal plane as the wind turbine component being lifted by the main bearing cable.

29. An apparatus for assembling a wind turbine, comprising:

a crane boom having a main bearing cable configured to be coupled to a component of a wind turbine at a primary lift location for lifting the component during assembly of the wind turbine, the longitudinal axis of the crane boom having a vertical component and the main bearing cable defining a main bearing axis; and a control mechanism operatively coupled to the crane boom for controlling the rotation of the wind turbine component about the main bearing axis, the control mechanism comprising:

a guide member coupled to the crane boom;

a movable member coupled to the guide member and configured to ascend and descend in a direction generally parallel to the longitudinal axis of the crane boom and to be guided by the guide member;

a coupling member configured to couple the movable member to the wind turbine component at a location spaced apart from the primary lift location and to be movable along an axis that is transverse to the main bearing axis; and a drive mechanism configured to actively raise and lower the movable member along the longitudinal axis of the crane boom independent of the movement of the main bearing cable.

* * * * *